US011015882B2

(12) United States Patent
Goel et al.

(10) Patent No.: US 11,015,882 B2
(45) Date of Patent: May 25, 2021

(54) ADJUSTABLE MULTI-PASS HEAT EXCHANGER SYSTEM

(71) Applicant: Lennox Industries Inc., Richardson, TX (US)

(72) Inventors: Rakesh Goel, Irving, TX (US); Mark Olsen, Carrollton, TX (US)

(73) Assignee: Lennox Industries Inc., Richardson, TX (US)

( * ) Notice: Subject to any disclaimer, the term of this patent is extended or adjusted under 35 U.S.C. 154(b) by 178 days.

(21) Appl. No.: 16/242,168

(22) Filed: Jan. 8, 2019

(65) Prior Publication Data

US 2019/0137201 A1 May 9, 2019

Related U.S. Application Data

(62) Division of application No. 14/686,898, filed on Apr. 15, 2015, now Pat. No. 10,203,171.

(60) Provisional application No. 61/981,445, filed on Apr. 18, 2014.

(51) Int. Cl.

| | |
|---|---|
| ***F28F 27/02*** | (2006.01) |
| ***F28F 9/02*** | (2006.01) |
| ***F28F 9/26*** | (2006.01) |
| ***F25B 39/00*** | (2006.01) |
| ***F25B 39/02*** | (2006.01) |
| ***F25B 49/02*** | (2006.01) |
| ***F28D 1/04*** | (2006.01) |
| ***F28D 21/00*** | (2006.01) |

(52) U.S. Cl.

CPC ..... *F28F 27/02* (2013.01); *F25B 39/00* (2013.01); *F25B 39/028* (2013.01); *F25B 49/027* (2013.01); *F28F 9/028* (2013.01); *F28F 9/262* (2013.01); *F25B 2400/075* (2013.01); *F25B 2600/02* (2013.01); *F25B 2600/05* (2013.01); *F25B 2600/2519* (2013.01); *F28D 1/04* (2013.01); *F28D 2021/007* (2013.01); *F28F 2250/06* (2013.01)

(58) Field of Classification Search

CPC .. F28F 27/02; F28F 9/028; F28F 9/262; F28F 2250/06; F28D 1/04; F28D 2021/007; F25B 49/027

See application file for complete search history.

(56) References Cited

U.S. PATENT DOCUMENTS

| | | | | |
|---|---|---|---|---|
| 2,998,227 | A | 8/1961 | Gaston | |
| 3,704,747 | A | 12/1972 | Andoniev et al. | |
| 3,774,678 | A | 11/1973 | Glorisi | |
| 3,789,919 | A | 2/1974 | Huber | |
| 4,646,818 | A * | 3/1987 | Ervin, Jr. ..... | E01C 11/26 126/271.1 |
| 4,738,309 | A | 4/1988 | Schilling | |

(Continued)

*Primary Examiner* — Jon T. Schermerhorn, Jr.

(74) *Attorney, Agent, or Firm* — Shackelford, Bowen, McKinley & Norton, LLP

(57) ABSTRACT

In various implementations, a heat exchanger system may include one or more flow paths. At least one of the flow paths may be associated with more than one pass and/or fluid flow through the flow path may be restricted. A setting of the heat exchanger system may include associations between flow path(s) and/or pass(es). A setting for the heat exchanger system may be determined, and the heat exchanger system may be allowed to operate in the determined setting, in some implementations.

20 Claims, 12 Drawing Sheets

(56) References Cited

U.S. PATENT DOCUMENTS

| | | | | |
|---|---|---|---|---|
| 4,798,242 | A * | 1/1989 | Kito | F28F 27/02 165/103 |
| 5,168,920 | A * | 12/1992 | Brauer | C12C 13/02 165/100 |
| 5,305,826 | A * | 4/1994 | Couetoux | F01P 7/16 123/41.08 |
| 5,452,686 | A | 9/1995 | Stahl | |
| 7,736,604 | B2 * | 6/2010 | Ashe | F16K 11/07 422/106 |
| 9,810,486 | B2 * | 11/2017 | Tylutki | F28F 5/00 |
| 2004/0013585 | A1 | 1/2004 | Whyatt et al. | |
| 2006/0201198 | A1 * | 9/2006 | Nishino | F28F 9/028 62/525 |
| 2009/0087355 | A1 * | 4/2009 | Ashe | F28F 27/02 422/600 |
| 2010/0078148 | A1 * | 4/2010 | Jouanny | F28D 1/0443 165/51 |
| 2011/0056668 | A1 * | 3/2011 | Taras | F28F 1/022 165/174 |
| 2012/0312510 | A1 * | 12/2012 | Eckberg | F28F 27/02 165/104.33 |
| 2014/0020883 | A1 * | 1/2014 | Christensen | F28F 27/02 165/260 |
| 2015/0176743 | A1 * | 6/2015 | Bauck Irmann-Jacobsen | F16L 53/30 165/296 |

* cited by examiner

ADJUSTABLE MULTI-PASS HEAT EXCHANGER SYSTEM

CROSS REFERENCE TO RELATED INFORMATION

This application is a divisional of U.S. patent application Ser. No. 14/686,898, filed on Apr. 15, 2015. U.S. patent application Ser. No. 14/686,898 claims the benefit of U.S. Provisional Patent Application No. 61/981,445, filed on Apr. 18, 2014. U.S. patent application Ser. No. 14/686,898 and U.S. Provisional Patent Application No. 61/981,445 are incorporated herein by references.

TECHNICAL FIELD

The present disclosure relates to heat exchanger systems, and more particularly to adjustable heat exchanger systems.

BACKGROUND OF THE INVENTION

Heat exchangers are often used as condensers and evaporators in air conditioning systems. The heat exchanger selected for a particular application is often based on a high load or an average load. Thus, when a system operates outside the condition for which it was designed, the heat exchanger may encounter problems (e.g., vapor provided in a liquid exit line, liquid provided in a vapor exit line, etc.) and/or an efficiency of the system may be less than optimal.

Another problem is that two-speed or variable heat exchangers may be able to run in high and low running states but do not normally use a variable charge (the level of refrigerant). The charge may be set for a value between the high and low states because the amount of refrigerant cannot be changed easily. As a result the amount of charge may not be chosen for the greatest efficiency. An inappropriate charge level can lead to excess gas and/or fluid in a system. In practice, because the charge level cannot be changed easily, heating and cooling systems are built to handle some excess gas and/or fluid depending on the high and low running states and the desired charge. Even so, these inefficiencies can lead to unwanted mechanical failures and inefficient use of resources or energy.

Another problem in the prior art is that, when a system is operating outside of a desired range or inefficiently, a mix of liquid and gas may pass through the heat exchanger. Certain portions of manifolds, along the edges of a heat exchanger may need certain amounts of liquid to collect at certain portions. And when insufficient or excess liquid collects it can cause problems in the system. With insufficient cooling, excess gas may be left in the system and may collect in certain areas of the system. This increases the likelihood of mechanical failure.

Because heat exchangers can be limited in the preset options or variables, they can often be poorly calibrated for how they're used in practice. Users may put heat exchangers under variable loads that the exchangers could not be calibrated for ahead of time.

BRIEF SUMMARY OF THE INVENTION

A heat exchanger system is disclosed. One advantage disclosed is a heat exchanger system able to variably handle high and low running states of as needed even when dealing with a constant charge. Another advantage described is the ability to combine multiple heat exchangers to yield a more capable system. Another advantage disclosed is a mechanism for separating gas from liquid within a heat exchanger system.

One embodiment comprises a multi-pass heat exchanger system comprising: an inlet operable to receive a fluid; a first heat exchanger comprising a first and second manifold and a first plurality of channels, at least one of the first plurality of channels comprising a first flow path, the first manifold operable to receive the fluid from the inlet and direct the fluid to the first flow path; a second heat exchanger comprising the second manifold and a third manifold and a second plurality of channels, at least one of the second plurality of channels comprising the first flow path, another at least one of the second plurality of channels comprising a second flow path, the third manifold operable to receive the fluid from the first flow path and direct the fluid to the second flow path, wherein the second flow path comprises at least one of the first plurality of channels; and a plurality of valves connected to the first and second plurality of channels, the plurality of valves operable to alter the number of the first and second plurality of channels comprising the first and second flow paths.

Another embodiment comprises a multi-pass heat exchanger system comprising: an inlet operable to receive a fluid; a plurality of manifolds; a plurality of channels connecting the plurality of manifolds; a first flow path, the first flow path comprising at least one of the plurality of channels and operable to receive the fluid from the inlet; a second flow path, the second flow path comprising at least one of the plurality of channels and operable to receive the fluid from the first flow path; and a plurality of valves, the plurality of valves operable to alter the number of the plurality of channels comprising the first and second flow paths.

Another embodiment comprises a method of operating a multi-pass heat exchanger system, comprising: determining, by a controller, a flow rate to an inlet of the multi-pass heat exchanger system that comprises a plurality of heat exchangers, a plurality of channels through the plurality of heat exchangers, and a plurality of manifolds connecting the heat exchangers; based on the flow rate, selecting, by a controller, a first plurality of channels to be a first pass and selecting a second plurality of channels to be a second pass; and adjusting, by a controller, valves in the multi-pass heat exchanger system to direct a fluid along the first pass and then along the second pass.

The foregoing has outlined rather broadly the features and technical advantages of the present invention in order that the detailed description of the invention that follows may be better understood. Additional features and advantages of the invention will be described hereinafter which form the subject of the claims of the invention. It should be appreciated by those skilled in the art that the conception and specific embodiment disclosed may be readily utilized as a basis for modifying or designing other structures for carrying out the same purposes of the present invention. It should also be realized by those skilled in the art that such equivalent constructions do not depart from the spirit and scope of the invention as set forth in the appended claims. The novel features which are believed to be characteristic of the invention, both as to its organization and method of operation, together with further objects and advantages will be better understood from the following description when considered in connection with the accompanying figures. It is to be expressly understood, however, that each of the figures is provided for the purpose of illustration and description only and is not intended as a definition of the limits of the present invention.

BRIEF DESCRIPTION OF THE DRAWINGS

For a more complete understanding of the present invention, reference is now made to the following descriptions taken in conjunction with the accompanying drawings, in which.

DETAILED DESCRIPTION OF THE INVENTION

Heat exchanger systems may be utilized in a variety of applications. Air conditioners may, for example, provide cooled and/or heated air to a location; provide cooled and/or heated air in vehicles (e.g., cars, trucks, boats, recreational vehicles); and/or provide dehumidified air. In some implementations, air conditioners, including heat pumps, may utilize heat exchanger systems as condensers and/or evaporators. In various implementations, refrigeration units may utilize heat exchanger systems (e.g., as condensers and/or evaporators) to provide cooled and/or dehumidified air to a refrigeration area.

In various implementations, a heat exchanger system may be utilized that allows a number of passes, a number of flow paths (or channels) utilized per pass, and/or which flow path is utilized with a specific pass to be adjusted. By allowing customization of flow path usage in a heat exchanger system, performance of the heat exchanger system and/or properties of stream(s) leaving the heat exchanger system may be controlled. By controlling the performance of the heat exchanger system and/or properties of the stream(s) leaving the heat exchanger system, costs may be reduced (e.g., by allowing more efficient operation when compared to a nonadjustable system) and/or problems may be reduced (e.g., by reducing vapor in liquid lines).

In various implementations, a heat exchanger system may include one or more heat exchangers and piping. The piping may provide fluid (e.g., refrigerant) to the heat exchanger system, provide fluid from a heat exchanger, couple one or more heat exchanger(s), and/or manage fluid flow in the heat exchanger system or portions thereof. For example, the piping may allow control of the direction of fluid flow in flow path(s) of the heat exchanger(s) of the heat exchanger system.

Figure 1A:
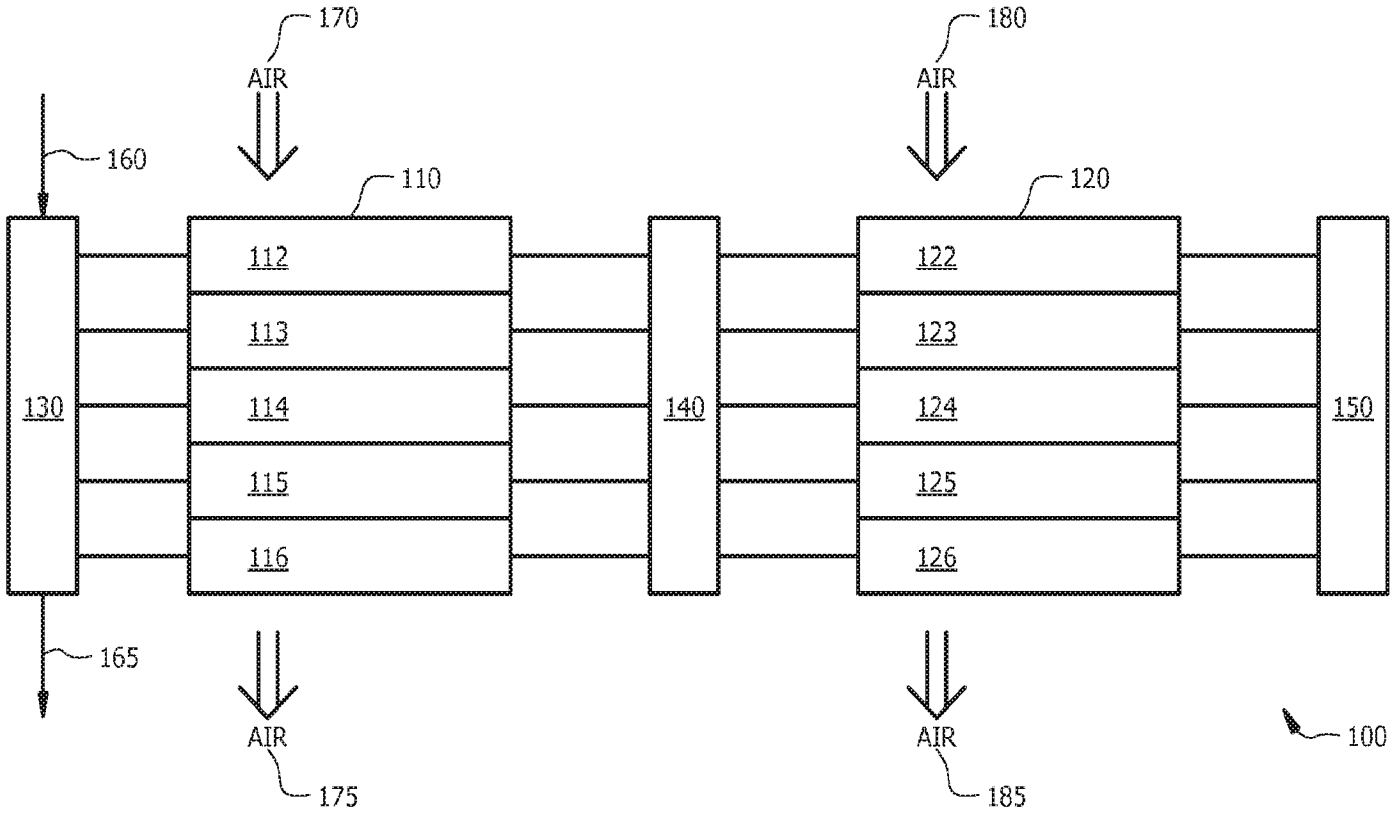
FIG. 1A illustrates an implementation of an example heat exchanger system.

FIG. 1A illustrates an embodiment of a heat exchanger 100. In most embodiments the fluid within the heat exchanger will be refrigerant and airflow will pass around and over the heat exchanger. However, other embodiments can use other fluids to flow around the heat exchanger. In some embodiments another fluid instead of air will be used and some embodiments will use another liquid such as refrigerant to flow around the heat exchanger.

FIG. 1A illustrates an implementation of an example heat exchanger system 100. The heat exchanger system 100 may include more than one heat exchanger. As illustrated, the heat exchanger system 100 includes a first heat exchanger 110, a second heat exchanger 120, and piping. The piping may includes lines (e.g., tubing) and/or valves (e.g., control valves) that control fluid flow in at least a portion of the heat exchanger system 100. The piping of the heat exchanger system 100 may include a first piping 130, a second piping 140, and a third piping 150. The piping (or manifolds) 130, 140, 150 may provide fluid flow into the heat exchanger system 100, provide fluid flow from the heat exchanger system 100, and/or couple the first heat exchanger 110 and the second heat exchanger 120.

The heat exchanger system 100 may include a first inlet 160 and a first outlet 165 for a first fluid, such as refrigerant (e.g., R-410A and/or a mixture of two or more types of refrigerant). The first fluid may be provided to the first inlet 160 from another component of the system in which the heat exchanger system 100 is used. For example, a discharge line from one or more compressor(s) may be coupled to an inlet of the heat exchanger system. The first inlet 160 may be coupled to the first heat exchanger 110 via the first piping 130, as illustrated.

The first outlet 165 of the heat exchanger system 100 may be coupled to other components of the system in which the heat exchanger system 100 is used, such as an expansion device. In some implementations, the first fluid may be allowed to flow through two or more passes in the heat exchangers 110, 120 of the system 100 and then be provided via the outlet 165 to other components of the system. As illustrated, the outlet 165 may be coupled to the first piping 130 to allow fluid to exit the heat exchanger system 100.

The heat exchanger system 100 may include second inlet(s) 170, 180 and second outlets 175, 185 to allow air to pass and flow over and about the heat exchanger. As illustrated, a first second inlet 170 and a first second outlet 175 may provide air to the first heat exchanger 110 and another second inlet 180 and another second outlet 185 may provide the air to the second heat exchanger 120 (in most embodiments the air will be moving in a direction perpendicular to the image i.e. towards or away from the reader). In some implementations, the air may be allowed to flow in a single pass and/or more than one pass in the heat exchanger system 100. In some implementations, one or more fans may be disposed proximate the heat exchanger system 100 to provide a stream of air 130. The fan(s) may provide air to the second inlet(s) 170, 180 and the processed air may exit the second outlet(s) 175, 185 of the heat exchanger system 100.

The heat exchanger(s) 110, 120 may include any appropriate heat exchanger. For example, the heat exchanger system 100 may include a microchannel heat exchanger, a shell in tube heat exchanger, a tube and fin heat exchanger, etc. The first heat exchanger 110 and the second heat exchanger 120 may be similar or different. For example, the first heat exchanger 110 and the second heat exchanger 120 may include similar or different capacities, number of settings, number of flow paths, types of heat exchangers (e.g., tube in shell and/or fin in tube), materials, etc.

One or more of the heat exchangers 110, 120 may include more than one flow path for the first fluid, in various implementations. As illustrated, the first heat exchanger 110 may include a first flow path 112, a second flow path 113, a third flow path 114, a fourth flow path 115, and a fifth flow path 116. The second heat exchanger 120 may include a sixth flow path 122, a seventh flow path 123, an eighth flow path 124, a ninth flow path 125, and a tenth flow path 126. One or more of the flow paths of the first heat exchanger 110 and/or second heat exchanger 120 may be capable of allowing fluid flow in one or more directions. For example, the heat exchanger system 100 may be utilized as a single pass or multi pass (e.g., two-pass and/or three pass) heat exchanger system.

Each flow path may include one or more conduits through which the first fluid may flow, in some implementations. For example, a flow path may include at least 10 conduits. The conduits may be the tubes in a tube and fin heat exchanger, tube in shell heat exchanger, and/or other types of heat exchangers. The tube(s) may include any appropriate material, such as copper. In some implementations, one or more of the conduits may be at least partially disposed in a second larger conduit.

One or more of the flow paths of a heat exchanger may be used for the first pass and/or any additional passes, such as the second pass. The first fluid may flow from the first fluid inlet 160 to the first pass (e.g., via the first piping and/or second piping) and through the first pass to a second pass (e.g., via the second piping and/or the third piping). The heat exchanger system 100 may be capable of adjusting which flow paths are utilized with a specific pass and/or restricting flow through one or more of the flow paths.

During use, a first fluid may be provided via the inlet 160 to the heat exchanger system 100. Air may be provided to each heat exchanger 110, 120 via inlets 170, 180 and the air may exit the heat exchangers 110, 120 via outlets 175, 185. The heat exchanger system 100 may allow heat transfer between the first fluid and the air via the heat exchangers 110, 120. For example, the first fluid may pass through a flow path of a heat exchanger (e.g., via conduit in the flow path) and the air may be allowed to flow through the flow path (e.g., flow across a surface of the conduit) to allow heat transfer between the first fluid and the air. The first fluid may be provided via the piping to one or more first flow paths from the inlet 160 for a first pass and/or one or more other flow paths for other pass(es).

Figure 1B:
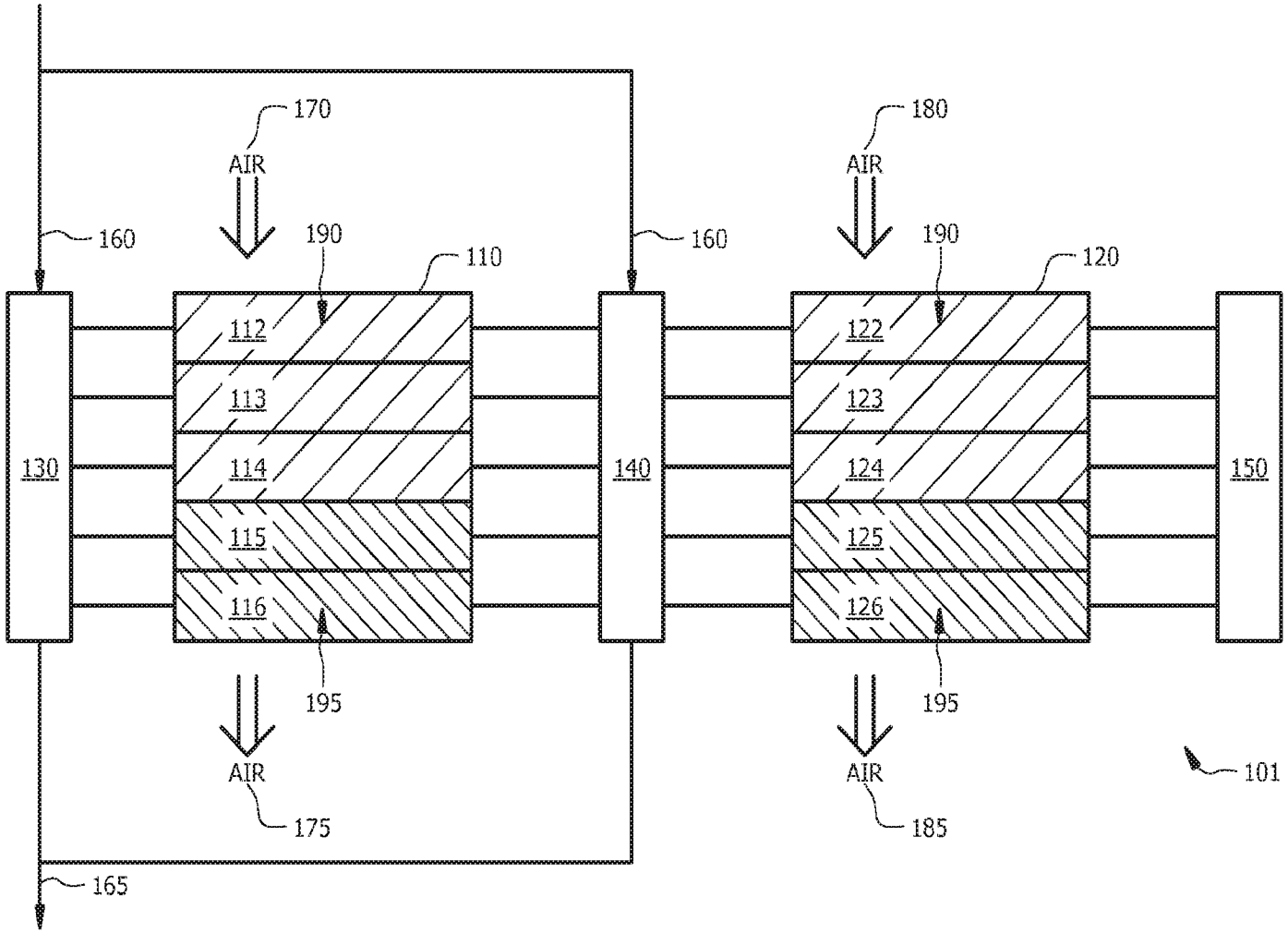
FIG. 1B illustrates an implementation of an example heat exchanger system.
Figure 1C:
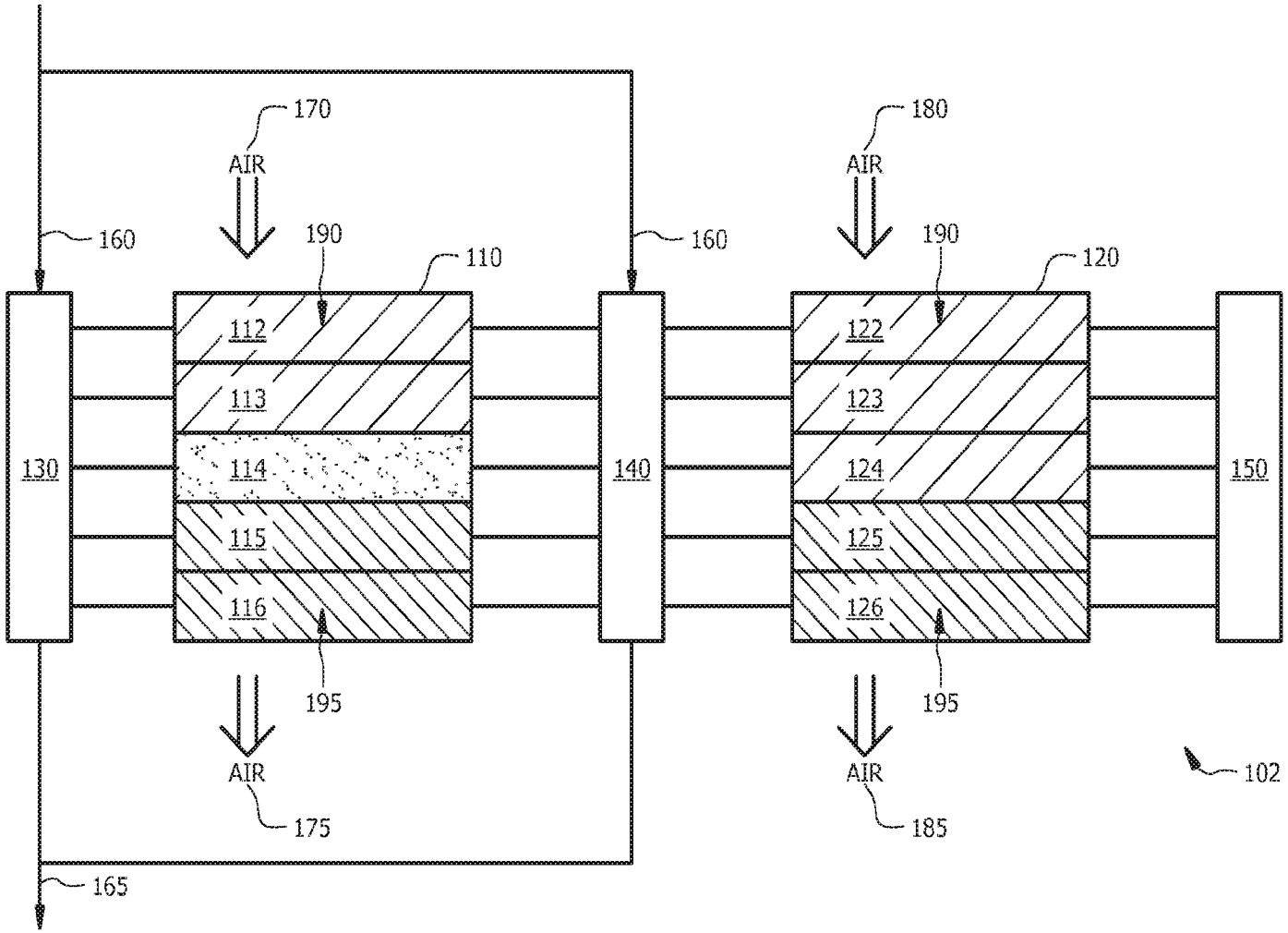
FIG. 1C illustrates an implementation of an example heat exchanger system.
Figure 1D:
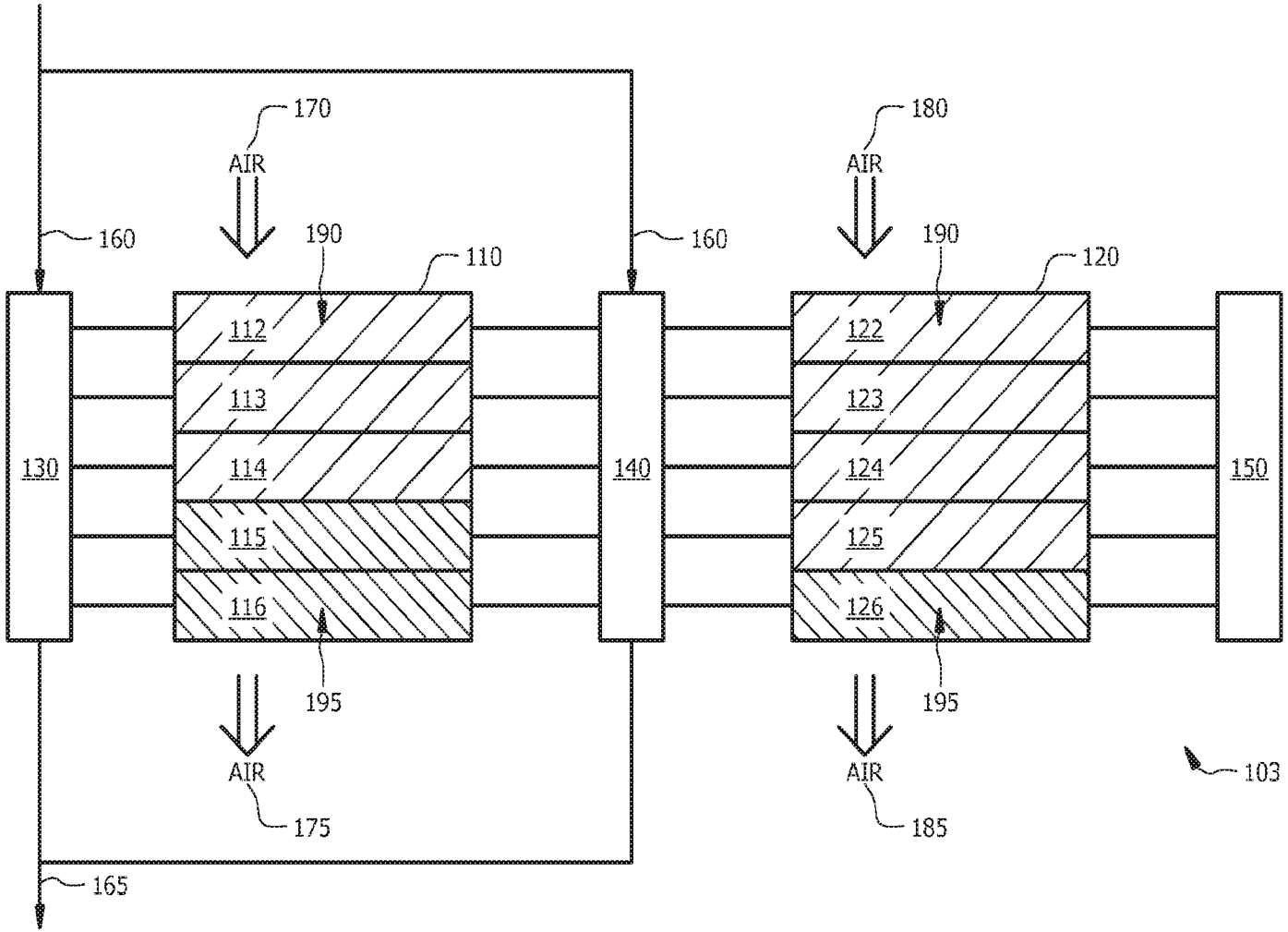
FIG. 1D illustrates an implementation of an example heat exchanger system.

In various implementations, a heat exchanger system, such as heat exchanger system 100, may allow one or more flow paths to be associated with a pass and/or may allow adjustment of the flow paths associated with a pass. FIG. 1B illustrates an implementation of an example heat exchanger system 101. FIG. 1C illustrates an implementation of an example heat exchanger system 102. FIG. 1D illustrates an implementation of an example heat exchanger system 103.

As illustrated, each of the heat exchanger systems 101, 102, 103 includes two heat exchangers 110, 120. The first piping 130 may control fluid flow for one or more passes of the first heat exchanger 110. The second piping 140 may control fluid flow for one or more passes of the first heat exchanger 110 and/or the second heat exchanger 120. The third piping 150 may control fluid flow for one or more passes of the second heat exchanger 120.

Any of the heat exchanger systems 100, 101, 102, 103 may include at least two passes and each pass may be associated with one or more flow paths. As illustrated in FIG. 1B, one or more of the heat exchangers may be coupled in parallel. The first pass 190 may include the first flow path 112, the second flow path 113, the third flow path 114, the sixth flow path 122, the seventh flow path 123, and the eighth flow path 124. The second pass 195 may include the fourth flow path 115, the fifth flow path 116, the ninth flow path 125, and the tenth flow path 126. The heat exchanger system 101 may include an inlet 160 that provides the first fluid to the first piping 130 and the second piping 140. The first fluid flowing into the heat exchanger system 101 may be split (e.g., evenly or unevenly) between the first piping 130 and the second piping 140. From the first piping 130, the first fluid may flow into the first flow path 112, the second flow path 113, and the third flow path 114 of the first heat exchanger 110 for the first pass 190. After the first fluid flows through the first flow path 112, the second flow path 113, and the third flow path 114, the first fluid may be provided to the second piping 140 that allows the first fluid to flow through the fourth flow path 115 and the fifth flow path 116 of the second pass 195. From the second piping 140, the first fluid may flow from the inlet 160 to the sixth flow path 122, the seventh flow path 123, and the eighth flow path 124 of the second heat exchanger 120 for the first pass 190. After the first fluid flows through the sixth flow path 122, the seventh flow path 123, and the eighth flow path 124 of the first pass 190, the first fluid may be provided to the third piping 150 that allows the first fluid to flow to the ninth flow path 125 and the tenth flow path 126 of the second pass 195.

In some implementations, one or more of the flow paths may be utilized in more than one pass based on settings (e.g., valve positions and/or signals from the controller) of the heat exchanger system. The heat exchanger system may adjust the flow paths utilized with one or more of the passes (e.g., first and/or second pass). For example, the heat exchanger system may adjust the flow paths utilized with one or more of the passes to maintain predetermined properties of the first fluid and/or the air (e.g., a vapor to liquid ratio) and/or maintain a performance of the heat exchanger system.

The heat exchanger system 101 may be adjusted to allow fluid flow, as illustrated in the heat exchanger system 102 of FIG. 1C. As illustrated, the first pass 190 may include the first flow path 112, the second flow path 113, the sixth flow path 122, the seventh flow path 123, and the eighth flow path 124. The fluid flow through the third flow path 114 may be restricted. For example, a valve that allows fluid flow through the third flow path 114 may be closed such that fluid flow through the third flow path may be restricted.

In some implementations, the heat exchanger system 101 illustrated in FIG. 1B, and/or the heat exchanger system 102 illustrated in FIG. 1C, may be adjusted to allow fluid flow as illustrated in the heat exchanger system 103 of FIG. 1D. As illustrated, the capacity of the first pass 190 may be increased by allowing the ninth pass 125 to be utilized with the first pass 190.

In some implementations, one or more of the flow paths may be restricted from utilization in more than one pass. For example, the first flow path 112 and/or the sixth flow path 122 may be restricted from being utilized with passes other than the first pass 190. In some implementations, the fifth pass 116 and/or the tenth pass 126 may be restricted from being utilized with passes other than the second pass 195.

Figure 1E:
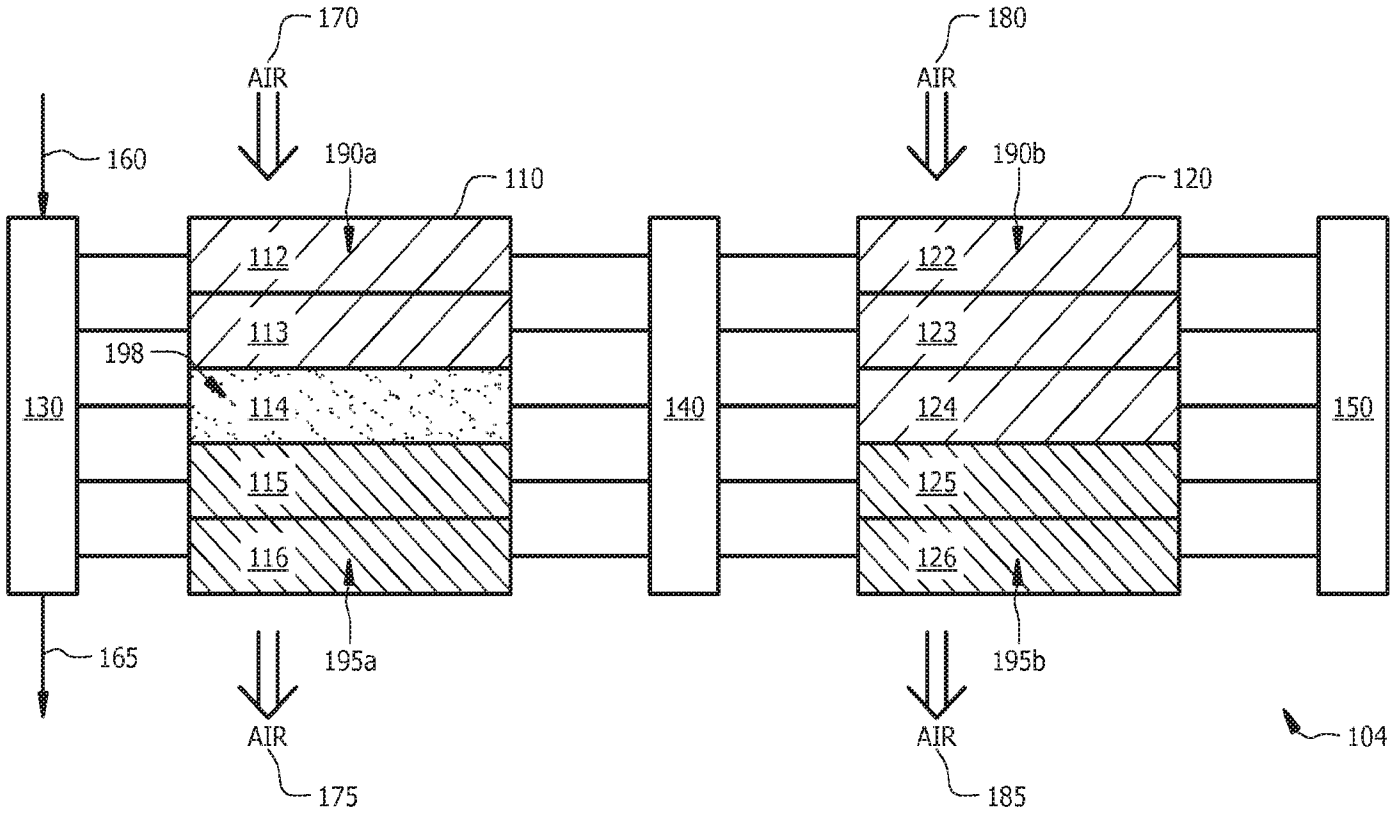
FIG. 1E illustrates an implementation of an example heat exchanger system.

In some implementations, one or more of the heat exchangers of the heat exchanger system may be coupled in series, as illustrated in FIG. 1E. As illustrated, the first fluid may flow through a first pass 190*a* in the first heat exchanger 110 and then via the second piping 140 be provided to a first pass 190*b* in the second heat exchanger 120. After the first passes 190*a*, 190*b*, the first fluid may be provided to second passes 195*a*, 195*b*. As illustrated, the fluid from the first pass 190*b* in the second heat exchanger 120 may be provided via the third piping 150 to the second pass 195*b* in the second heat exchanger 120. The fluid may then be provided from the second pass 195*b* in the second heat exchanger 120 to the second pass 195*a* in the first heat exchanger 110 via the second piping 140.

The flow paths associated with the passes may be adjusted, in some implementations. For example, flow through the third flow path 114 and/or the fourth flow path 115 may be restricted. In some implementations, fluid flow through the fourth flow path 115 and/or the ninth flow path 125 may be adjusted such that the fourth flow path 115 and/or the ninth flow path 125 are associated with the first pass 190 rather than the second pass 195.

In some implementations, a heat exchanger system may include settings. Each setting may include an association between one or more of the flow paths and one or more of the passes. Flow thorough one or more of the flow paths may be restricted in some implementations of settings. For example, the implementation illustrated in FIG. 1B may be associated with a first setting, the implementation illustrated in FIG. 1C may be associated with a second setting, and/or the implementation illustrated in FIG. 1D may be associated with a third setting. As illustrated, adjustment of one or more flow paths, such as the first flow path 112 and/or the fifth flow path 116 may be restricted from being adjusted. In some implementations, one or more flow paths may be adjusted from being associated with a first pass 190 to a second pass 195 and/or vice versa. In some implementations, fluid flow through one or more flow paths may be restricted and/or the flow path(s) may be associated with one or more of the passes.

Figure 1F:
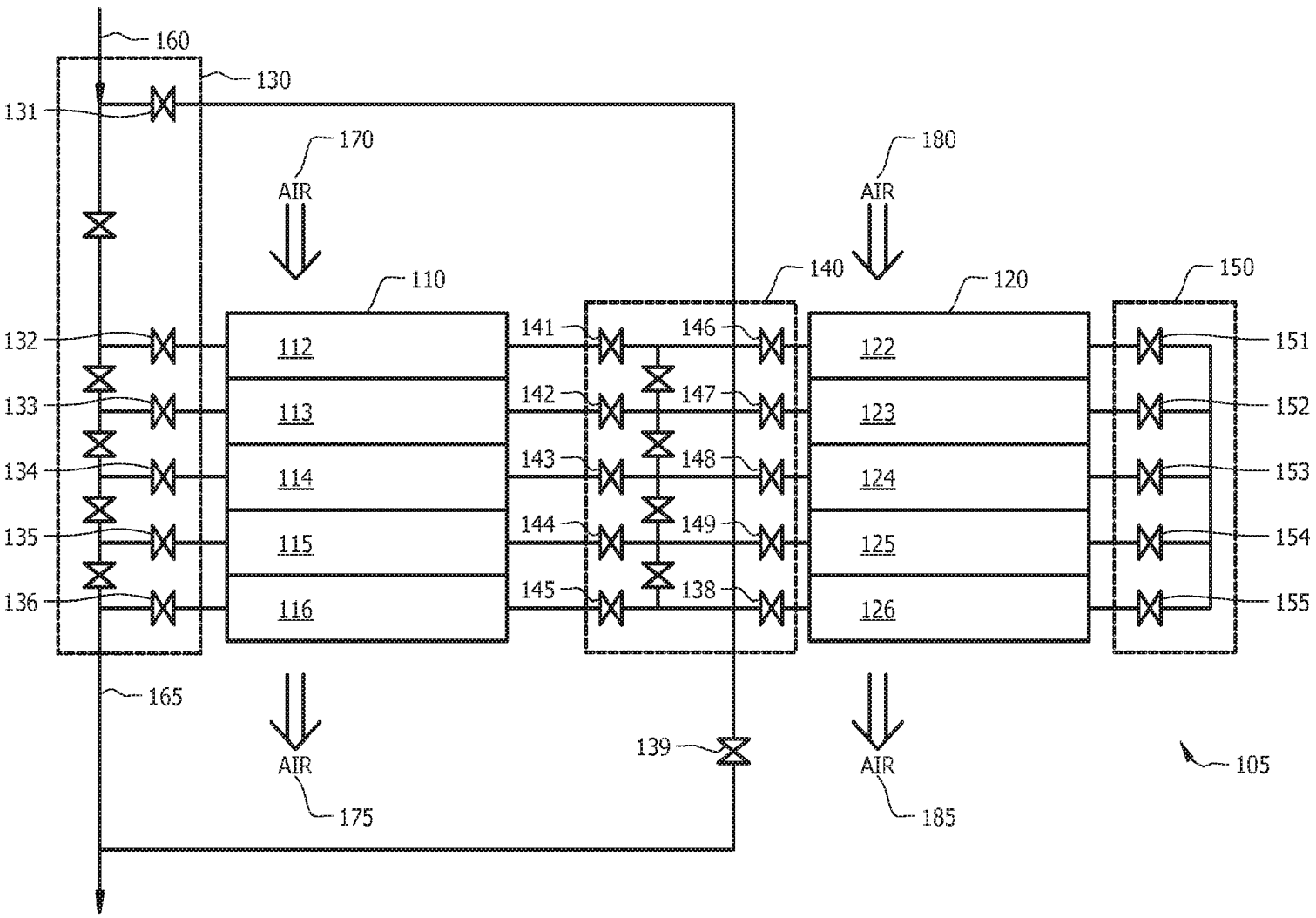
FIG. 1F illustrates an implementation of an example heat exchanger system.
Figure 1G:
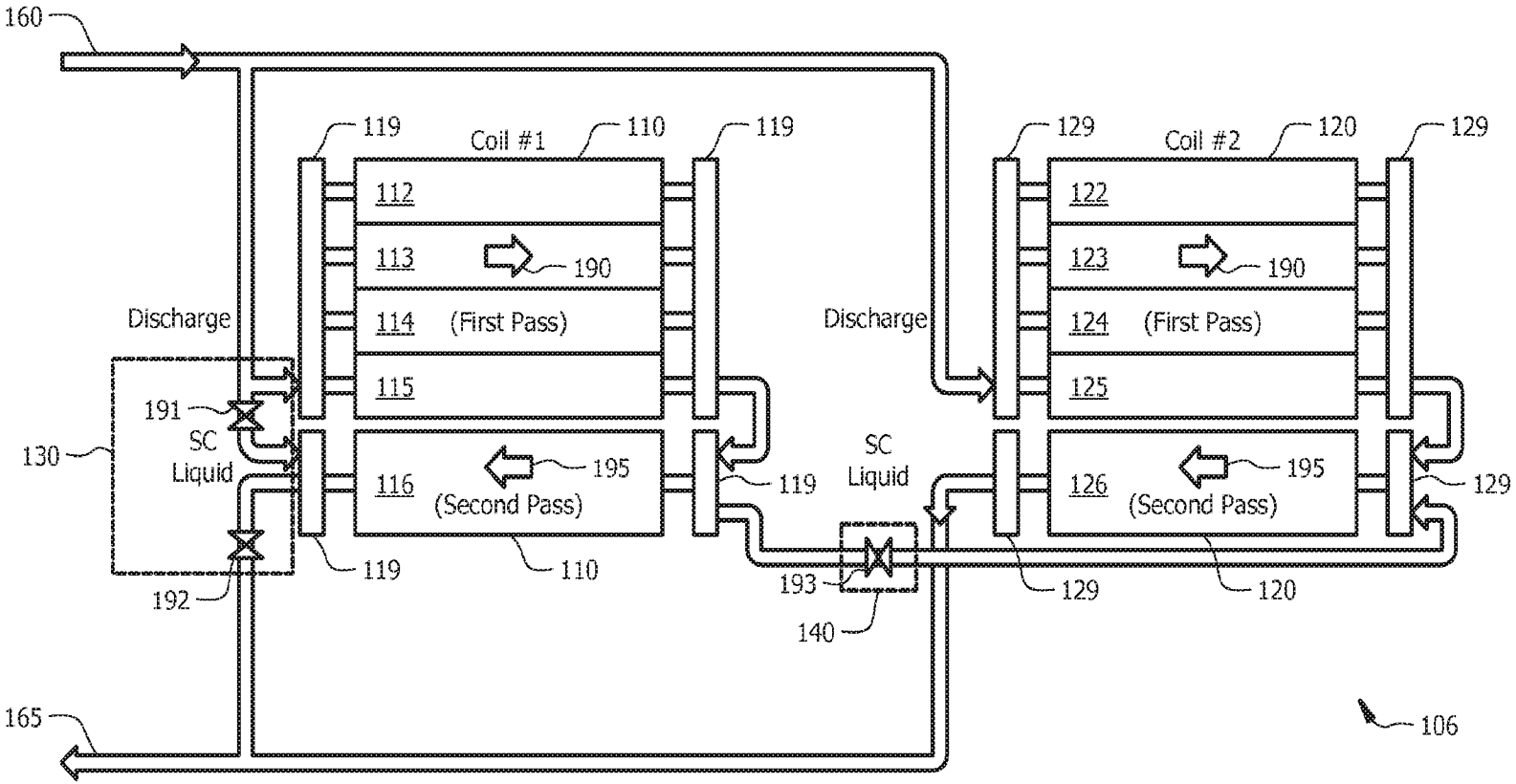
FIG. 1G illustrates an implementation of an example heat exchanger system operating in a first setting.
Figure 1H:
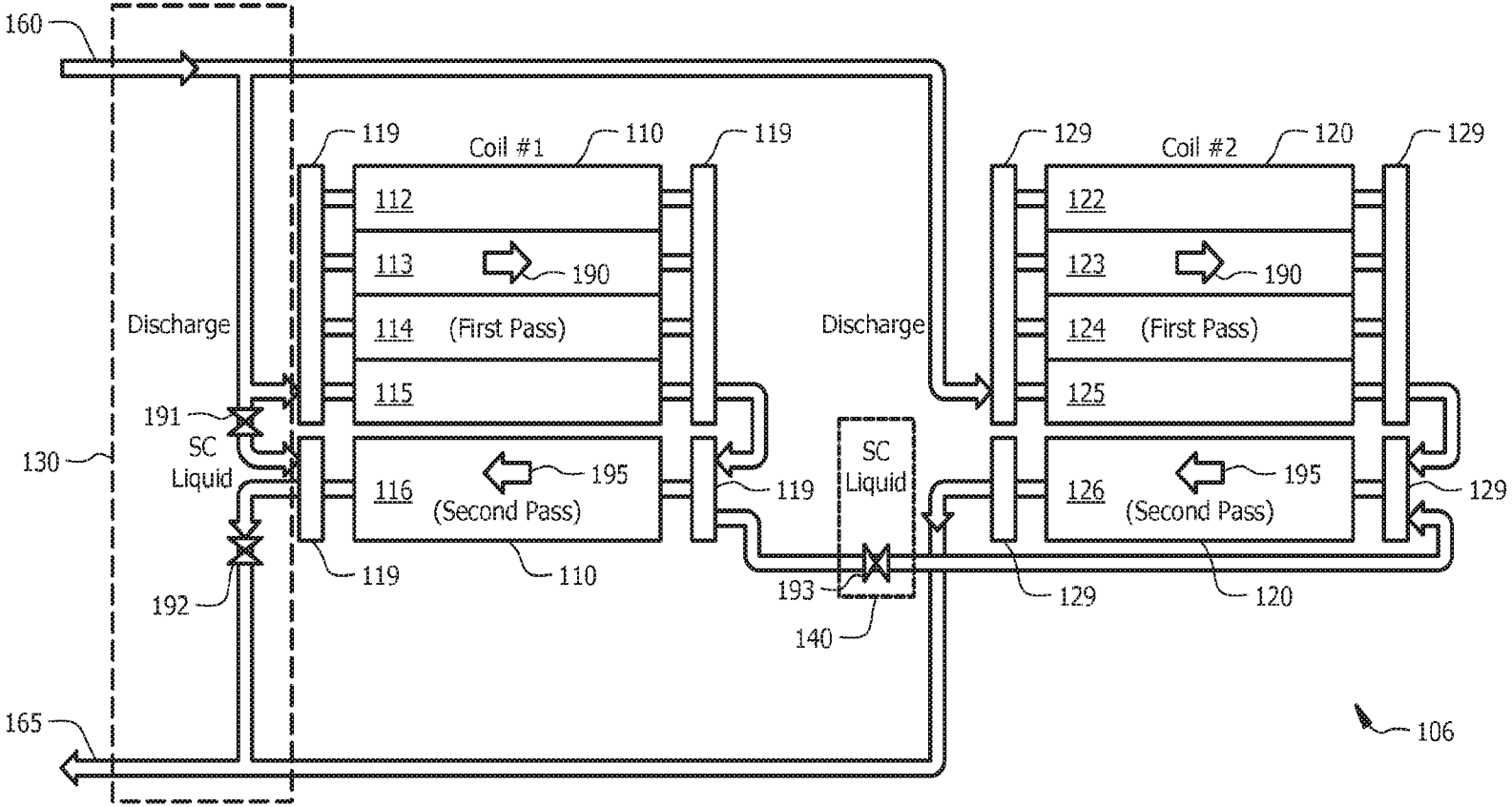
FIG. 1H illustrates an implementation of the example heat exchanger of FIG. 1G operating in a second setting.

In various implementations, the piping or manifolds of the heat exchanger system may include valves and/or lines. The piping may allow adjustment of the settings of the heat exchanger system. As illustrated in FIG. 1F through FIG. 1H, the piping of the heat exchanger system may include one or more valves coupled to the first fluid inlet, the first fluid outlet, and/or flow path(s) to control fluid flow (e.g., restricted and/or allowed direction of fluid flow in a flow path). FIG. 1F illustrates an implementation of an example heat exchanger system 105. FIG. 1G illustrates an implementation of an example heat exchanger system 106 operating in a first setting. FIG. 1H illustrates an implementation of the example heat exchanger 106 operating in a second setting.

As illustrated in FIG. 1F, the first piping 130 may include valves 131 through 136, which allow and/or restrict fluid flow in the flow paths of the first heat exchanger 110. The first piping 130 may include a valve 131 which may allow and/or restrict fluid flow to the second piping 140 and/or to the second heat exchanger 120 via the second piping 140. By allowing fluid flow from the inlet 160 to the second piping 140, the first fluid from the inlet 160 may be split to allow two or more parallel first passes. As illustrated, the second piping 140 may include valves 138, 139 and 141 through 149, which may allow and/or restrict fluid flow between the heat exchangers 110, 120, between flow paths, and/or between heat exchanger(s) and the first fluid outlet 165. The third piping 150 may include valves 151 through 155, which may allow and/or restrict fluid flow between one or more of the flow paths of the second heat exchanger 120. A heat exchanger system may include one or more of the illustrated valves. By adjusting the valve position of the valves of the heat exchanger system, the fluid flow direction may be adjusted. For example, if fluid flow from an inlet is restricted and fluid flow from a second heat exchanger is allowed through the second piping to the first heat exchanger, a first flow direction may be allowed. If the fluid flow from the inlet is not restricted, a second flow direction may be allowed.

As illustrated in FIG. 1G and FIG. 1H, the heat exchanger system 106 includes a piping system with valves, such as a first valve 191, a second valve 192, and/or a third valve 193. The valves may be opened and/or closed to manage fluid flow. Setting(s) may be associated with one or more combinations of valve positions. For example, a first setting may include a closed first valve 191, an open second valve 192, and a closed third valve 193. The first setting may be associated with a full load (e.g., based on operating conditions of the heat exchanger system, such as compressor load, fluid properties, etc.). For example, when the first valve 191 is closed, fluid may flow from the first inlet 160 through manifolds 119 to the first flow path 112, the second flow path 113, the third flow path 114, and the fourth flow path 115 as the first pass 190. When the second valve 192 is opened, the fluid from the fifth flow path 116, which is associated with the second pass 195, may be allowed to pass to the outlet 165. When the third valve 193 is closed, fluid flow between the fifth pass 116 of the first heat exchanger 110 and the tenth flow path 126 of the second heat exchanger 120 may be restricted.

A second setting may include an open first valve 191, a closed second valve 192, and an open third valve 193. The second setting may be associated with a part load (e.g., based on operating conditions of the heat exchanger system, such as compressor load, fluid properties, etc.). For example, when the first valve 191 is open, fluid flow from the first inlet 160 through manifolds 119 to the fifth flow path 116 may be allowed. Thus, the first pass 190 may include the first flow path 112, the second flow path 113, the third flow path 114, the fourth flow path 115, and the fifth flow path 116 of the first heat exchanger 110. The second heat exchanger 120 may include flow paths in the first pass. When the second valve 192 is closed, the fluid from the fifth flow path 116, which is associated with the first pass 190, may be restricted from passing to the outlet 165 via the valve 192. Thus, the fluid from the inlet 160 may not pass through the valve 192 and into the outlet 165 without being processed by the heat exchanger system 106. When the third valve 193 is open, fluid flow between the fifth pass 116 of the first heat exchanger 110 and the tenth flow path 126 of the second heat exchanger 120 may be allowed. Thus, the fluid from the fifth flow path 116 may be provided with at least a portion of the other fluid from the first pass 190 to the tenth flow path 126, which is associated with the second pass 195.

Thus, when a heat exchanger system is adjusted from a first setting to a second setting, the position of the appropriate valves may be adjusted (e.g., a controller may transmit signals to the valve(s) to open and/or closed based on a setting).

Although FIG. 1A through FIG. 1H illustrate specific implementations of heat exchanger systems, other implementations may be utilized. For example, a heat exchanger system may include three heat exchangers. In some implementations, one or more of the heat exchangers may include one or more flow paths. For example, one or more heat exchangers of the heat exchanger system may include a single flow path. A heat exchanger may include five flow paths. The heat exchangers of the heat exchanger system may include the same or different number of flow paths. The piping of the heat exchanger system may be coupled to the single flow path heat exchanger to allow this heat exchanger to be utilized in one or more passes for the heat exchanger system. The inlet 160 and/or the outlet 165 may be coupled to the first piping 130, the second piping 140, and/or the third piping 150, in some implementations. In some implementations, the first fluid may include any appropriate fluid, such as refrigerant(s) and/or gasses, such as air. Although air passes over the heat exchangers in the described embodiments, other gasses or liquids could used with the heat exchangers without departing from the scope of the concepts described herein.

In some implementations, the heat exchanger system may include any appropriate number of flow paths, such as more than five flow paths. In some implementations, one or more flow paths may be restricted from being utilized with one or more of the passes. For example, a first flow path may be utilized by the first pass and restricted from being utilized by the second pass. In some implementations, the fifth flow path may be utilized with the second pass and restricted from being utilized by the first pass. In some implementations, one or more flow paths may be utilized with more than one pass or with none of the passes (e.g., fluid flow through the flow path may be restricted). Each of the flow paths may be associated with a single pass in some implementations.

In some implementations, a heat exchanger system may include a plurality of settings. A setting may associate each flow path with either a pass (e.g., first pass, second pass, and/or third pass) or restrict fluid from flowing through the flow path. A heat exchanger system may allow adjusting of the setting(s) in which the heat exchanger system is allowed to operate. A controller may utilize a setting (e.g., information about a setting, such as associations between flow paths and/or passes) to determine which valve settings (e.g., position) to adjust.

In some implementations, one or more of the flow paths may be associated with a pass and alteration of the associated pass may be restricted. For example, a first flow path may be associated with a first pass and the first flow path may be restricted from being associated with other passes.

In some implementations, a controller (e.g., of the heat exchanger system and/or system in which the heat exchanger system operates) may be coupled to and/or may be a portion of the heat exchanger system (e.g., to manage operations of the heat exchanger system). The controller may be any appropriate programmable logic device, such as a computer. The controller may include a memory to store data (e.g., setting information, criteria to facilitate determinations of which settings to utilize and/or when to adjust settings, and/or any other appropriate data) and instructions. The controller may include a processor to execute the instructions (e.g., a module) stored in the memory. For example, the controller may include operation module(s) that allow operation of the heat exchanger system and/or other components coupled to the controller. The controller may include an adjustment module(s) to evaluate input, such as settings of components coupled to the controller and/or properties of fluid in an inlet of a heat exchanger system; determine which setting to allow (e.g., based on evaluated input); determine whether to adjust a setting of a heat exchanger system based on the evaluation; determine whether valve positions should be adjusted; adjust valve positions based on a setting; allow operation of the heat exchanger system based on a setting; and/or other appropriate operations.

In some implementations, the piping may include any appropriate valve(s) and/or any appropriate sensor(s). For example, the valve(s) may include one or more solenoid valves, directional valves (e.g., three-way valves and/or four-way valves), electronically operated valves, and/or any other appropriate type of valve. The valve(s) and/or sensor(s) may be coupled to a controller that manages operation of the valves and/or determines properties as measured by the sensor(s). For example, the controller may transmit a signal to set the valve position (e.g., open, partially open, and/or closed). Thus, to allow a heat exchanger system to operate at a setting, the controller may transmit one or more signals to one or more valves to adjust and/or maintain valve position(s).

In some implementations, one or more of the heat exchangers of the heat exchanger system may include one or more manifolds. A manifold may provide fluid to one or more passes. For example, a first fluid may flow from a first inlet into a first set of manifolds. A second set of manifolds may be disposed between one or more of the passes, in some implementations.

In some implementations, one or more heat exchangers of the heat exchanger system may utilize manifolds in addition to and/or instead of a piping or portion thereof. For example, a manifold may be utilized in a second heat exchanger that couples one or more of the flow paths (e.g., such that the first fluid may flow from a first pass to a second pass), rather than utilizing the third piping. In some implementations, the heat exchanger system may include one or more of the heat exchangers that may utilize piping and one or more of the heat exchangers that may utilize manifold(s).

Figures 2A, 2B, 2C, 2D:
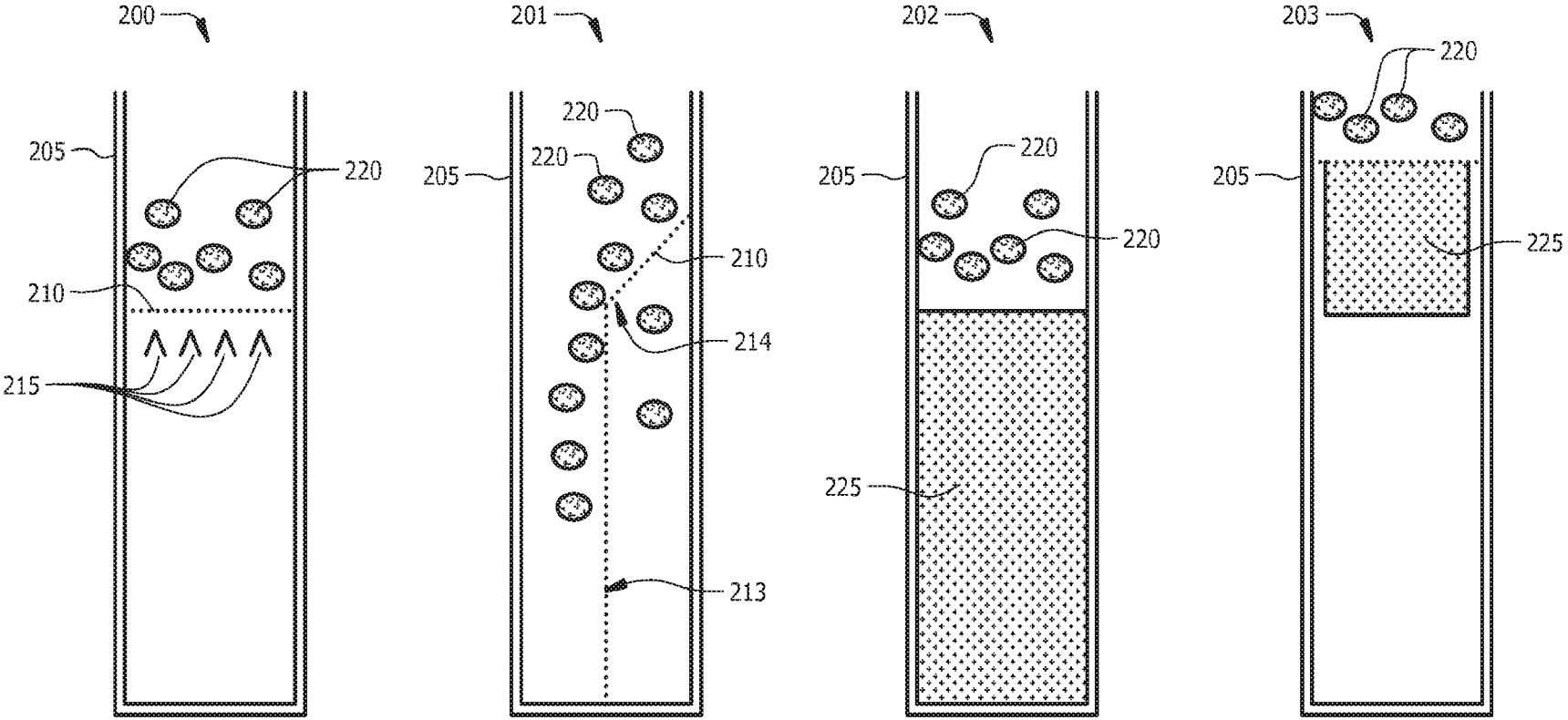
FIG. 2A illustrates an implementation of a portion of an example manifold.
FIG. 2B illustrates an implementation of a portion of an example manifold.
FIG. 2C illustrates an implementation of a portion of an example manifold.
FIG. 2D illustrates an implementation of a portion of an example manifold.

In various implementations, one or more of the manifolds, such as the second set of manifolds between one or more of the passes may include one or more mixing members. The mixing member(s) in a heat exchanger system may be utilized in conjunction with flow paths that may be utilized with more than one pass and/or may be restricted from use. For example, the mixing members may be disposed at least partially in the second manifold and may facilitate obtaining a mixture, which may be provided to the second pass or other passes after the first pass, in a predetermined property range (e.g., by promoting mixing). FIG. 2A illustrates an implementation of a portion 200 of an example manifold in the second set of manifolds. As illustrated, the manifold 205 includes a mixing member. The mixing member includes a perforated plate 210 and an agitator 215. The perforated plate 210 may extend across the manifold 205 such that the fluid passes through the perforated plate 210 to flow to the second pass. The position of the perforated plate 210 may be selected to inhibit a quantity of vapor greater than a predetermined quantity (e.g., greater than 50% of the fluid entering a tube in a flow path is vapor), in some implementations. As fluid enters the manifold 205, the liquid droplets 220 of fluid and the vapor are agitated by the agitator 215 to further the mixing of the liquid and vapor phases (e.g., to increase the degree of homogeneity) and pass through the perforated plate 210 to the second pass of the heat exchanger system.

FIG. 2B illustrates an implementation of a portion 201 of an example manifold in the second set of manifolds. As illustrated, the manifold 205 includes a mixing member. The mixing member may include a perforated plate 210. The perforated plate 210 may include a sloped portion 214 and a planar portion 213. The perforated plate 210 may agitate and/or deflect the liquid droplets 220 of the fluid towards the second pass of a heat exchanger system. Sloped portion 214 may also help to decrease the volume within manifold 205 as this may assist in maintaining the proper amount of fluid flow within the system.

FIG. 2C illustrates an implementation of a portion 202 of an example manifold in the second set of manifolds. As illustrated, the manifold 205 includes a mixing member. The mixing member may include a mesh portion 225. The mesh portion 225 may be disposed proximate the inlet of the second pass, in some implementations. The mesh portion 225 may extend across the manifold 205 such that the fluid passes through the mesh portion 225 to flow to the second pass, in some implementations. The mesh portion 225 may provide a larger surface area (e.g., when compared to implementations without a mesh portion) in which the liquid droplets 220 and vapor may interact and thus increase mixing (e.g., increase the degree of homogeneity).

FIG. 2D illustrates an implementation of a portion 203 of an example manifold in the second set of manifolds. As illustrated, the manifold 205 includes a mixing member. The mixing member may include a mesh portion 225. The mesh portion 225 may be disposed proximate the inlet of the second pass. The mesh portion 225 may at least partially extend across the manifold 205 such that the fluid passes through the mesh portion to flow to the second pass. The mesh portion 225 may provide a larger surface area (e.g., when compared to implementations without a mesh portion) in which the liquid droplets 220 and vapor may interact and thus increase mixing (e.g., increase the degree of homogeneity). The mesh portion 225 may be agitated, in some implementations to increase mixing.

Although the mixing members are described in FIG. 2A through FIG. 2D as a portion of an adjustable heat exchanger system, the mixing members may be utilized with other heat exchanger systems. For example, one or more flow paths of the heat exchanger system may not be adjustable with respect to which pass the flow path(s) is associated but the heat exchanger system may include one or more of the mixing members. In some implementations, one or more of the mixing members or portions thereof may be utilized in the same heat exchanger system.

In some implementations, the heat exchanger system may include a single heat exchanger. In some implementations, more than two heat exchangers may be utilized in the heat exchanger system. For example, three or more heat exchangers may be coupled via the piping in series and/or parallel. At least one of the heat exchangers may include more than one flow path. In some implementations, one or more of the heat exchangers may include a single flow path. Each flow path may include one or more paths (e.g., created by a channel, conduit, fin, etc.). At least one of the heat exchangers may include at least one flow path that may be associated with more than one pass and/or through which flow may be restricted. In some implementations, one or more of the heat exchangers may include flow paths that are fixed rather than associated with more than one pass. A heat exchanger may include a combination of flow path(s) that are fixed; flow path(s) that may associated with more than one pass; and/or flow path(s) through which flow may be restricted, in some implementations. Associating a flow path with a pass may include utilizing valve positions that allow fluid to flow through a valve and into a flow path. The pressure differentials (e.g., created by fluid flow from the suction line and/or from the discharge of the heat exchanger) may at last partially determine the direction of fluid flow in the heat exchanger system.

Systems incorporating the teachings described can include a series-type setup. In a series setup the outlet of a heat exchanger may flow directly or indirectly into the inlet of a next heat exchanger. The desirability of such a setup may be useful in certain situations depending on space available for implementation of condensers (or heat exchangers or air conditioning systems, etc.) or on special heating or cooling requirements. For example, one embodiment could comprise a first heat exchanger comprising three manifolds and two sets of channels further comprising an outlet that flow directly to the inlet of a second heat exchanger comprising four manifolds and three sets of channels.

While FIGS. 1A-1H show an outlet for the heat exchangers coming from the first piping or manifold such as piping 130 in FIG. 1A, various embodiments could utilize outlets located at various locations. Embodiments could have multiple outlets that are switched on or off depending on the current use.

Figure 2E:
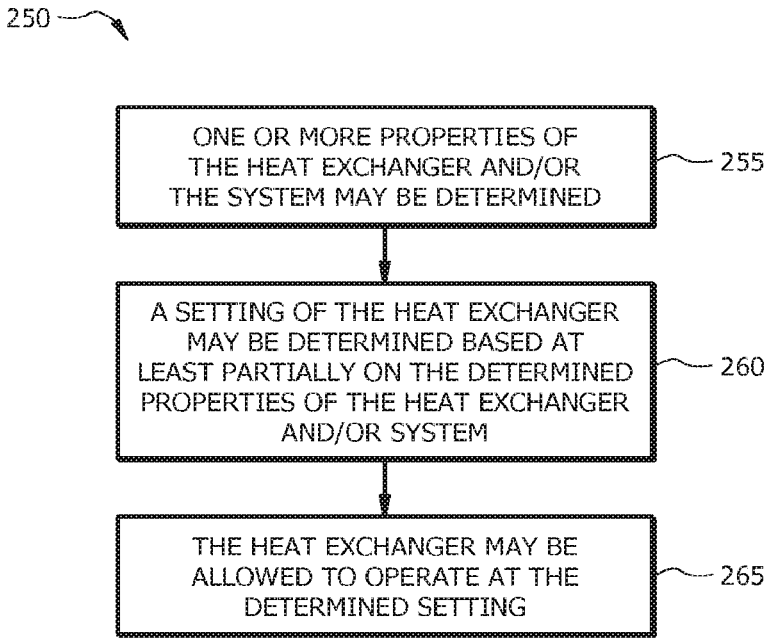
FIG. 2E illustrates an implementation of an example process for operation of a heat exchanger system.

FIG. 2E illustrates an implementation of an example process 250 for operation of a heat exchanger system, such as the heat exchanger systems illustrated in FIG. 1A through FIG. 1H, in a system within which the heat exchanger system is used. One or more properties of the heat exchanger system and/or the system (e.g., of which the heat exchanger system is a component) may be determined (operation 255). For example, one or more properties (e.g., a pressure, temperature, viscosity, density, and/or flow rate) of a first fluid in a first inlet may be determined. In some implementations, such as in a refrigeration system, a property such as a setting (e.g., full load, part load, and/or number of units operating) of compressor(s) of the system may be determined. In some implementations, a property, such as a setting of fan(s) of the system, may be determined.

A setting of the heat exchanger system may be determined based at least partially on the determined properties of the heat exchanger system and/or the system within which the heat exchanger system is used (operation 260). A heat exchanger system may have two or more settings. A setting may include operating parameters for the heat exchanger system, such as valve positions, associations between flow path(s) and pass(es), and/or other appropriate parameters. For example, in a first setting of a heat exchanger system, a first fluid may flow in a first set of flow paths for a first pass and exit the first pass to flow into a second pass that includes a second set of flow paths. In a second setting of a heat exchanger system, the first fluid may flow into a third set of flow paths for the first pass and exit the first pass to flow into a second pass that includes a fourth set of flow paths. A controller may determine which of the settings of the heat exchanger system should be allowed by retrieving associations between settings and properties of the system.

The heat exchanger system may be allowed to operate in the determined setting (operation 265). For example, if a determination is made to utilize the first setting, then the heat exchanger system may be allowed to operate at the first setting. The valves of the heat exchanger system may be adjusted, in some implementations, to allow the fluid flow of the first setting. For example, valve(s) allowing fluid flow from the first fluid inlet through a first flow path, a second flow path, and a third flow path may be opened and valves allowing fluid flow from the first fluid inlet to the fourth flow path and the fifth flow path may be closed (e.g., to restrict fluid flow in a direction). In some implementations, allowing the heat exchanger system to operate at a determined setting may include determining valve positions for piping(s) of the heat exchanger system.

Process 250 may be implemented by various heat exchanger systems, such as heat exchanger system 106. In addition, various operations may be added, deleted, and/or modified. For example, one or more properties (e.g., a pressure, temperature, and/or flow rate) of a first fluid in at least a portion of the second manifold may be determined. A setting may be selected based at least partially on whether one or more of the determined fluid properties are within a predetermined first fluid range (e.g., vapor/liquid ratio range, degree of homogeneity range; temperature range and/or pressure range). Thus, for example, if the degree of homogeneity (e.g., a measure of the dispersal of vapor in a liquid) of a first fluid in the second manifold is not within a predetermined degree of homogeneity, then the setting may be adjusted. In some implementations, the heat exchanger system may include more or fewer valves to control fluid flow and/or to associate flow paths with pass(es) in the heat exchanger system.

In various implementations, a heat exchanger system may include settings that allow flow and/or properties of the fluid flowing through the heat exchanger system to be adjusted, managed, and/or maintained. Settings may be stored in a memory of the controller of a device and/or the heat exchanger system. A processor of the controller may retrieve the settings from the memory and execute one or more operations to allow the setting to be implemented in the heat exchanger system. For example, a setting may associate flow path(s) to pass(es) and/or restrict flow through flow path(s). Each setting may be associated with valve positions for the piping of the heat exchanger system, in some implementations. For example, a setting may indicate which valves should be open, closed, and/or partially open. In some implementations, multi-directional valves may be utilized and a setting may indicate in which direction fluid flow should be allowed. Thus, when a determination is made that a setting should be allowed, a controller may determine the appropriate signals to be sent to component(s). For example, a controller may transmit signal(s) to valve(s) to indicate that a valve position should be adjusted and/or maintained. The valve(s) may receive the transmitted signal(s) and adjust and/or maintain valve position, as appropriate, based on the transmitted signal.

In various implementations, the settings allowed and/or stored in a memory of a heat exchanger system and/or controller may be based on other components of the system in which the heat exchanger system is used. For example, when a variable speed compressor is utilized, a plurality of settings may be utilized to account for the differing loads of the compressor.

In various implementations, the described heat exchanger system may be utilized in a variety of systems. A heat exchanger system may be coupled to a device that produces different loads. For example, the device may produce different loads that are accommodated by the heat exchanger system when multi component systems, such as tandem compressors, and/or variable operation components, such as variable load compressors and/or variable speed fans, are utilized. To accommodate the different loads, the heat exchanger system may adjust based on the load. By utilizing an adjustable heat exchanger system, rather than a fixed heat exchanger (e.g., designed for maximum loads and/or average loads), performance may be improved (e.g., by maintaining fluid properties in a predetermined range in various points of the heat exchanger system, such as reducing the amount of vapor in liquid lines and/or amount of liquid in vapor lines).

Thus, a controller may determine a load of a device and/or may determine whether a change in the load of a device has occurred (e.g., based on measurements from sensors and/or operating instructions issued for components). The controller may then determine whether a setting of the heat exchanger system should be adjusted based on the determined load and/or determined change in load. For example, the controller may retrieve criteria associated with settings (e.g., a first setting is associated with a first predetermined load, a second setting is associated with a second predetermined load, etc.) and determine a setting for the heat exchanger system. The controller may then determine whether an adjustment to the current setting should be made based on a comparison of the current setting and the determined setting. The controller may then transmit one or more signals, as appropriate, to allow the heat exchanger system to operate in the determined setting. The determined setting may associate flow paths of one or more heat exchangers with passes. For example, a first setting may associate a first set of flow paths in the first heat exchanger and/or the second heat exchanger with a first pass and a second set of flow paths in the first heat exchanger and/or the second heat exchanger with a second pass. A second setting may associate a third set of flow paths in the first heat exchanger and/or the second heat exchanger with a first pass and a fourth set of flow paths in the first heat exchanger and/or the second heat exchanger with a second pass. A third setting may associate a fifth set of flow paths in the first heat exchanger and/or the second heat exchanger with a first pass; a sixth set of flow paths in the first heat exchanger and/or the second heat exchanger with a second pass; and/or restrict fluid flow in a seventh set of flow paths in the first heat exchanger and/or the second heat exchanger. Valve positions for the valves in the piping(s) may be associated with the settings and may control the fluid flow through the flow paths.

Figure 3:
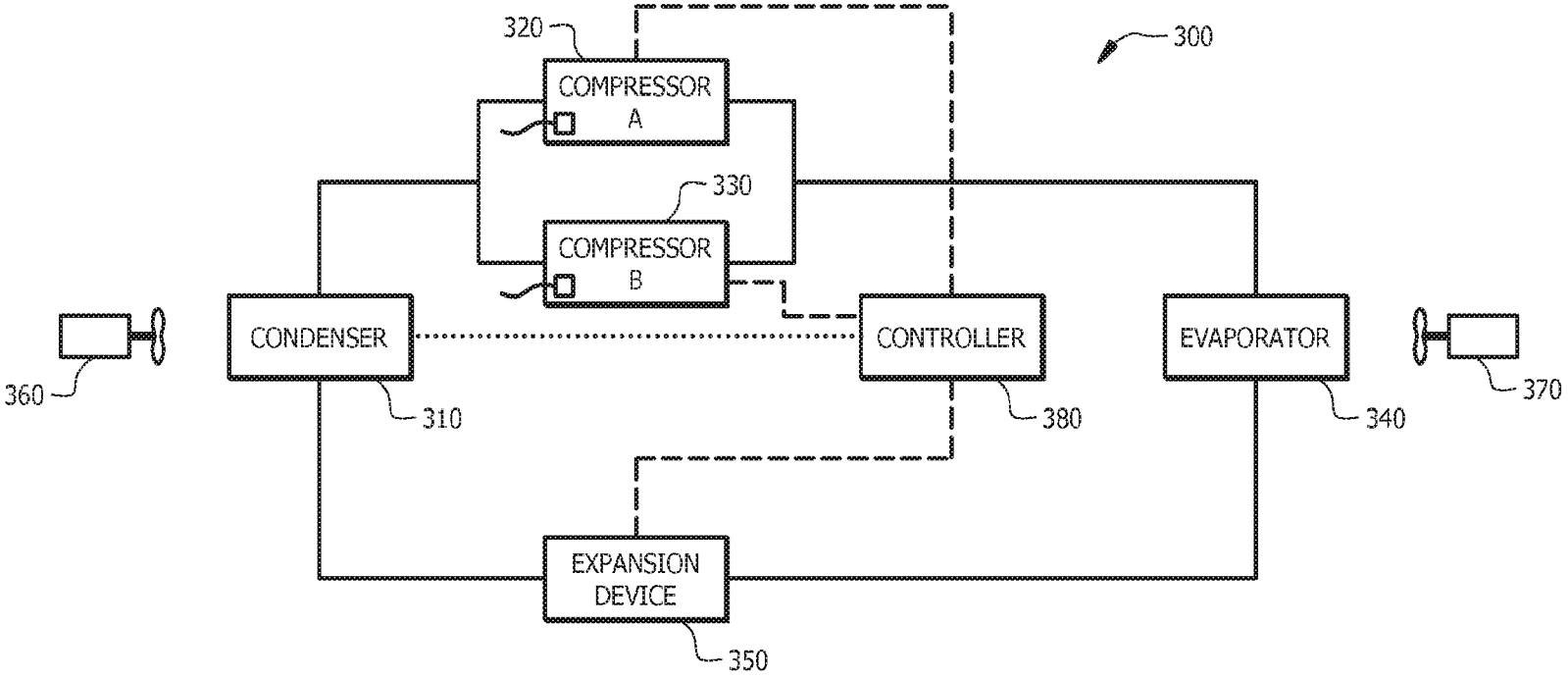
FIG. 3 illustrates an implementation of an example air conditioner.

In some implementations, the heat exchanger system may operate as a condenser and/or evaporator in an air conditioning system and/or refrigeration system. For example, FIG. 3 illustrates an implementation of an example air conditioner 300. The condenser and/or evaporator may be a heat exchanger system as illustrated in FIG. 1A through FIG. 1H, in some implementations.

FIG. 3 illustrates an implementation of an example air conditioner 300. The air conditioner may include components such as a condenser 310, compressor A 320, compressor B 330, evaporator 340, and expansion device 350. Lines (e.g., tubing) may couple various components and allow refrigerant to flow in and/or out of various components of the air conditioner 300.

Fans 360, 370 may cause air to flow through the condenser 310 and/or the evaporator 340. The air conditioner 300 may include more than one fan to provide air flow to the condenser 310 and/or more than one fan to provide air flow to the evaporator 340. The air conditioner 300 may include a first condenser fan, a second condenser fan, and a third condenser fan to provide air flow to the condenser 310 and a first evaporator fan, a second evaporator fan, and a third evaporator fan to provide air flow to the evaporator 340, in some implementations.

The condenser 310 may include an appropriate condenser. In some implementations, the condenser 310 may be a microchannel condenser (e.g., condenser with a channel size less than approximately 1 mm). Microchannel condensers may be sensitive to operating conditions during operation of the air conditioner (e.g., when compared with other condensers (e.g., condenser with tube size greater than 5 mm)). For example, microchannel condensers may be sensitive to refrigerant charge (e.g., a level of refrigerant in the system). When a microchannel condenser has a refrigerant charge greater than a maximum operating charge, the pressure in the microchannel condenser may become elevated due to the refrigerant capacity size difference between the microchannel condenser and the evaporator. The high pressures (e.g., pressures greater than approximately 615 psi, with a refrigerant that includes R-410A refrigerant) may cause mechanical failure, including prefailure events, such as excessive wear on parts and/or high pressure switch activations.

The condenser 310 and/or the evaporator 340 may also include one or more of the features of the heat exchanger systems described in FIG. 1A through FIG. 1H. For example, the condenser 310 may include a heat exchanger system 106 as illustrated in FIG. 1G and FIG. 1H.

For example, the condenser 310 may include a first fluid inlet that couples the discharge line from the compressor(s) 320, 330 to the condenser 310. The condenser 310 may include a first fluid outlet line that couples the first fluid outlet to the expansion device 350.

The condenser 310 may include a heat exchanger system that includes two or more heat exchangers, which may operate to include two or more passes. For example, the heat exchanger system may include a first pass and a second pass. Each heat exchanger of the heat exchanger system may include a plurality of flow paths, such as a first flow path, a second flow path, and a third flow path. When the first fluid, such as refrigerant, flows from the compressor discharge line to the first pass, it passes through a first set of manifolds prior to entering the first pass. Then the refrigerant exits the first pass and enters a second set of manifolds. The refrigerant passes through the second set of manifolds to the second pass. The first set of manifolds may include a manifold coupled to each of the flow paths and the second set of manifolds may include manifolds coupled to one or more of the flow paths.

The heat exchanger system may include valves to control the direction of fluid flow in one or more of the flow paths. For example, a first valve may be positioned in the line that couples the compressor discharge line to the one of the flow paths of the first heat exchanger (e.g., fifth flow path). The first valve may allow the flow path to operate as a part of the first pass and/or second pass. A second valve may be positioned in the line that couples at least one of the flow paths (e.g., fifth flow path) of the first heat exchanger to the first fluid outlet line. A third valve may be positioned in a line that couples at least one of the flow paths (e.g., fifth flow path) of the first heat exchanger to a flow path of the second heat exchanger (e.g., tenth flow path). When the first valve is open, the refrigerant may be allowed to flow from the compressor discharge line to the flow path (e.g., via a manifold); and when the first valve is closed, refrigerant is restricted from flowing from the compressor discharge line to this flow path. When the second valve is open, fluid may flow from the flow path to the first fluid outlet (e.g., via a manifold); and when the second valve is closed, fluid in this flow path may be restricted from flowing into the first fluid outlet line. When the third valve is open, the refrigerant may be allowed to flow between the first heat exchanger and the second heat exchanger. When the third valve is closed, the refrigerant may be restricted from flowing between the heat exchangers.

In some implementations, the condenser that includes more than one heat exchanger may operate at more than one setting. The first setting may be used, when the compressor(s) are operating at full load. When refrigerant enters the second set of manifolds (e.g., after being processed through the first pass), the refrigerant may include a mixture of vapor and liquid refrigerant. In the second pass(es), the refrigerant may be further liquefied. When the compressor(s) are allowed to operate at a full load setting, the mixture entering the second pass may have properties within a predetermined refrigerant property range. For example, the refrigerant may have a degree of homogeneity within a predetermined homogeneity range. The refrigerant may have a ratio of vapor to liquid within a predetermined range and/or the refrigerant may have other properties (e.g., temperature and/or pressure) within a predetermined property range.

A second setting may be used, for example, when the compressor(s) are operating at part load. In some implementations, if the first setting was utilized rather than the second setting, the mixture entering the second pass may not have a property (e.g., pressure, temperature, degree of homogeneity) within a predetermined property range.

A third setting may be used, in some implementations. In some implementations, if the first setting or the second setting was utilized rather than the third setting, the mixture entering the second pass may not have a property (e.g., pressure, temperature, degree of homogeneity) within a predetermined property range. The valves of the piping may be adjusted to allow operation of the heat exchanger system according to the parameters of a setting.

As illustrated in FIG. 3, fan 360 may provide air flow to the condenser 310 and fan 370 may provide air flow to the evaporator 340. The fans 360, 370 may include any appropriate number of fans, such as one, two, three, or four fans. Fans 360, 370 may be any appropriate type of fan, such as a centrifugal fan. A fan may include more than one fan setting. For example, the fan may be a multi-speed fan (e.g., one or more settings) and/or a variable speed fan. For example, a fan may allow operation at 800 RPM (rotations per minute), 650 RPM, and/or 330 RPM. In some implementations, a fan may include a low setting and more than one high setting.

The compressors 320, 330 of the air conditioner 300 may include any appropriate arrangement of compressors (e.g., in series and/or in parallel). The compressors 320, 330 may include a tandem compressor system. The tandem compressor system may allow more than one compressor (e.g., compressor A 320 and compressor B 330) to share discharge lines and suction lines.

Compressor A 320 and/or compressor B 330 may include single stage and/or multi-stage (e.g., more than one stage, such as two stage, three stage, and/or variable) compressors. Compressor A 320 and compressor B 330 may be independently operable, in some implementations. For example, compressor A 320 may be allowed to operate and compressor B 330 may be restricted from operation. Operations of the compressors may include full load operations and part load operations. A full load operation may include operation of each compressor of the air conditioner. A part load operation may include allowing operation of one or more compressors and restricting operation of one or more compressors. For example, a part load operation may allow one compressor to operate and restrict operation of the other compressors.

The air conditioner 300 may include an expansion device 350, as illustrated. The expansion device 350 may include any device that at least partially expands refrigerant passing through the device. For example, the expansion device 350 may include a thermal expansion valve, an orifice, and/or an electronic expansion valve.

A controller 380 (e.g., a computer) may be coupled (e.g., communicably, such as by wires or linked by Wi-Fi) to component(s) of the air conditioner 300 and control various operations of the component(s) and/or system. For example, the controller 380 may include modules (e.g., instructions executed by a processor of the controller), such as an operation module and/or an adjustment module, stored in a memory of the controller and executable by a processor of the controller, to perform various operations of the air conditioner 300. The operation module may control operations of the air conditioner 300, such as receiving requests for operation, determining whether to respond to requests for operation, operating various components (e.g., compressors, reversing valves, and/or expansion valves), etc. The adjustment module may operate one or more components of the air conditioner 300, measure and/or determine one or more properties of the system or portions thereof, determine whether changes have occurred, retrieve tables of associations (e.g., to associate a change detected with criteria for determining whether to determine a heat exchanger system setting and/or tables that associate properties with settings of the heat exchanger system, determine settings, determine whether to allow adjustments to settings, compare one or more values, and/or allow operation of a component at a setting). For example, the adjustment module may determine properties of the air conditioner (e.g., ambient temperature, temperature proximate a portion of the air conditioner, pressure of at least a portion of the air conditioner), retrieve one or more predetermined values for properties, determine a setting of a heat exchanger system, adjust a configuration of a heat exchanger system based on a determined setting, allow operation of a heat exchanger system at the setting, and/or any other appropriate operation.

The controller 380 may include a memory that stores the modules (e.g., instructions) and/or other data. For example, the memory may store predetermined property values (e.g., temperature, compressor load values, vapor pressure, vapor to liquid ratios, and/or any other appropriate value); criteria; tables of associations (e.g., between changes, properties, and/or compressor settings and heat exchanger system settings); and/or other appropriate data.

Although FIG. 3 illustrates an implementation of an air conditioner, other implementations may be utilized as appropriate. For example, the air conditioner may include any component, as appropriate. The air conditioner may include three or more heat exchangers and two or more passes. In some implementations, a setting of the heat exchanger system (e.g., the condenser and/or the evaporator) may include restriction of operation of one or more of the heat exchangers. The air conditioner may not include an expansion device. The air conditioner may include more than two compressors (e.g., a tandem compressor with four compressors). The air conditioner may include one compressor, such as a two-stage compressor and/or a variable compressor. In some implementations, the expansion device may include more than one expansion device. The air conditioner may be a heat pump and may include a reversing valve to allow cooling and heating operations. The fans 360 and/or the fans 370 may include a different number or the same number of fans. In some implementations, one or more of the compressors may include a crankcase heater. In some implementations, systems other than heat exchanger systems may utilize one or more of the described features.

In some implementations, a portion of the air conditioner 300 may be disposed outside a building (e.g., an "outdoor portion" on the ground proximate a building and/or on a roof of the building) and a portion of the air conditioner 300 may be disposed inside the building (e.g., an "indoor portion"). For example, the outdoor portion may include the condenser 310 and fans 360 and the indoor portion may include the evaporator 340 and fans 370. In some implementations, such as a rooftop unit, the condenser 310, fans 360, compressor A 320, compressor B 330, evaporator 340, fans 370, and the expansion device 350 may be disposed in the outdoor portion. The outdoor and/or indoor portion may be at least partially disposed in housing(s).

During a cooling cycle of the air conditioner 300, cool air may be provided by blowing air (e.g., from fans 370) at least partially through the evaporator 340. The evaporator 340 may evaporate liquid refrigerant in the evaporator. The evaporator 340 may reduce a temperature of the air and the cool air may be provided to a location (e.g., via ducting). The gaseous refrigerant may exit the evaporator 340, and may be compressed by compressor A 320 and compressor B 330, and delivered to a condenser 310. The condenser 310 may condense the gaseous refrigerant by blowing air (e.g., from fans 360) at least partially through the condenser 310 to remove heat from the gaseous refrigerant.

In various implementations, the heat exchanger system may be utilized in applications in which the heat exchanger system operates in a range of operating parameters. For example, when a system includes more than one compressor, a multi-speed compressor (e.g., two-stage compressor and/or variable compressors), variable second refrigerant flow rates (e.g., more than one fan and/or a multi-speed fan coupled to the heat exchanger system to provide air), and/or other changes in operating parameters, the setting of the heat exchanger system may be determined and/or altered based on the changes in operating parameters. For example, a described heat exchanger system may be utilized as a condenser in an air conditioner. The air conditioner may include more than one compressor (e.g., a tandem compressor) that operates at full load and/or part load(s). As the setting of the compressor changes (e.g., from full load to part load), properties of the fluid in the discharge line of the condenser changes and thus the conversion of vapor refrigerant to liquid refrigerant in the condenser may be affected.

Figure 4:
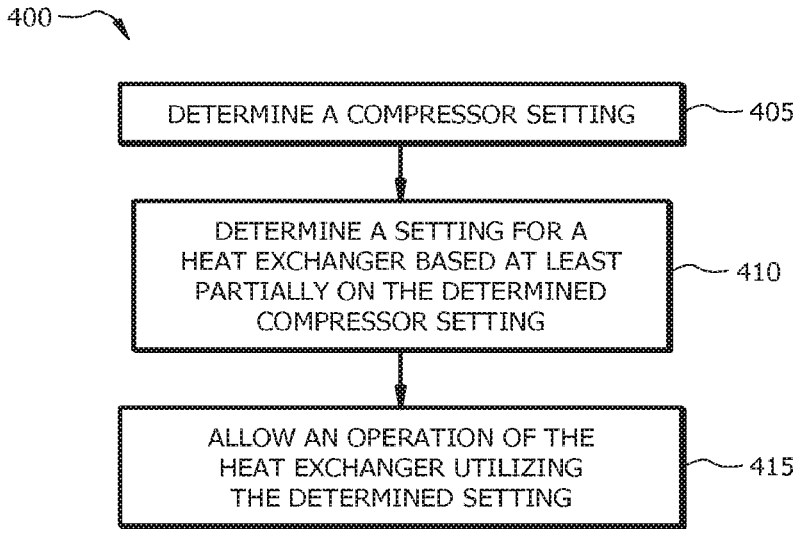
FIG. 4 illustrates an implementation of an example process for operation of a heat exchanger system.

A heat exchanger system that has more than one setting may be utilized in a device, such as an air conditioner or refrigeration system. FIG. 4 illustrates an implementation of an example process 400 for a heat exchanger system with more than one heat exchanger. The heat exchanger system may include more than one setting. Each setting may be associated with a set of valve positions that associate flow path(s) with pass(es). One or more flow paths of one or more of the heat exchangers may be utilized with a single pass and/or more than one pass. In some implementations, fluid flow through one or more of the flow paths may be restricted in one or more of the settings. The heat exchanger system may be coupled to a compressor outlet via the first fluid inlet and to an expansion valve inlet via the first fluid outlet. The heat exchanger system may include one or more fans that provide stream(s) of air to the heat exchangers. The heat exchanger system may operate to remove heat from the first fluid, refrigerant (e.g., a fluid that includes, but is not limited to, one or more types of refrigerant) to produce a refrigerant stream at the first fluid outlet that includes the refrigerant in a liquid state (e.g., a ratio of vapor to liquid in the refrigerant may be less than a predetermined liquid value, such as less than 0.10).

A compressor setting of the device may be determined (operation 405). The compressor(s) may be able to operate at more than one compressor setting (e.g., full load, part load). For example, a compressor may be capable of operating in more than one stage and/or more than one compressor may be utilized in a system (e.g., when more than one compressor is utilized, various stages may be generated by allowing and/or restricting operation of one or more of the compressors). Thus, a determination may be made as to which compressor setting the compressor(s) are operating. For example, the controller may determine one or more properties of the refrigerant in the discharge line from the compressor to determine the compressor setting. The controller may determine operating parameters of the compressor(s) (e.g., on/off, stage of operation, etc.) to determine a compressor setting and/or the controller of the system may determine the compressor setting using other appropriate techniques.

A setting for the heat exchanger system may be determined based at least partially on the determined compressor setting (operation 410). A heat exchanger system may include, but is not limited to, a first setting and a second setting. In some implementations, the heat exchanger system may include a third setting and/or other settings. For example, a first setting for the heat exchanger system, in which a first pass includes a first set of flow paths, may be selected for a first compressor setting in which a full load is allowed. A second setting for the heat exchanger system, in which a first pass includes a second set of flow paths, may be selected for a second compressor setting, in which a part load is allowed. In some implementations, a third setting for the heat exchanger system, in which a third set of flow paths, may be selected for a second compressor setting in which a first part load is allowed, or a third compressor setting in which a second part load (e.g., a second part load that is less than the first part load) is allowed. The setting may be associated with one or more valve positions for the piping of the heat exchanger system. The setting may control fluid flow in the heat exchangers of the heat exchanger system. For example, flow direction may be at least partially controlled by paths created by valve positions in the heat exchanger system.

An operation of the heat exchanger system may be allowed utilizing the determined setting (operation 415). The heat exchanger system may be configured based on the determined setting, and operation of the heat exchanger system may be allowed in the determined setting. For example, a determined setting may be compared to a current setting of the heat exchanger system. If the determined setting is the same as the current setting of the heat exchanger system, then adjustment of the setting and/or configuration of the heat exchanger system may be restricted and the current setting of the heat exchanger system may be maintained. If a determined setting is different from a current setting of the heat exchanger system, then a configuration of the heat exchanger system may be modified. For example, if the current setting includes allowing fluid flow through a second flow path and a determined setting restricted fluid flow through the second flow path, then a first valve which allows fluid flow to the second flow path may be closed.

Process 400 may be implemented by various systems, such as system 300. In addition, various operations may be added, deleted, and/or modified. In some implementations, process 400 may be performed in combination with other processes such as process 250.

Figure 5:
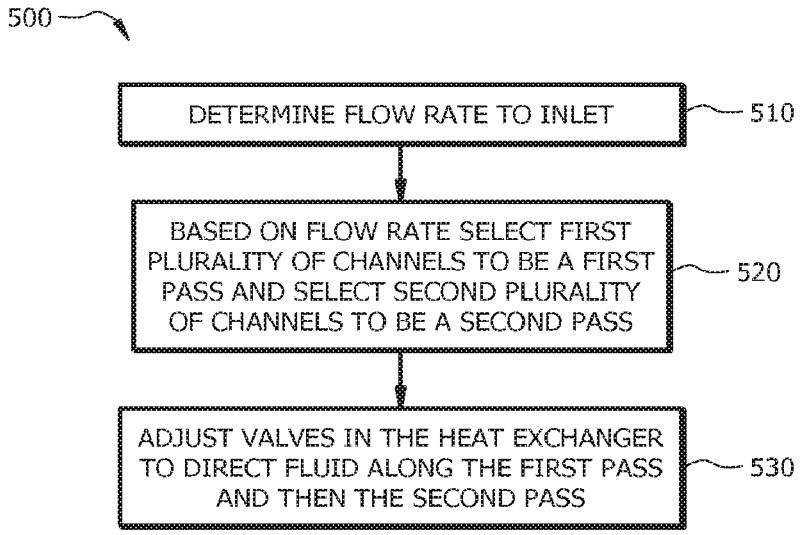
FIG. 5 illustrates an implementation of an example process for operation of a heat exchanger system.

FIG. 5 displays a process for implementing an embodiment of the invention. First, a flow rate is determined for a heat exchanger 510. Then, based on the flow rate, a first plurality of fluid channels are selected to comprise a first pass 520 and a second plurality of fluid channels are selected to comprise a second pass 520. Finally, valves in the heat exchanger are adjusted to direct a fluid along the first and second passes 530.

In some implementations, determining a setting of a heat exchanger system may be based on properties of the heat exchanger system, system, and/or portions thereof. For example, determining a setting of a heat exchanger system may be based on one or more properties (e.g., temperature, pressure, vapor pressure, flow rate, type of first fluid etc.) of a first fluid inlet. Determining a setting of a heat exchanger system may be based on one or more properties (e.g., temperature, pressure, vapor pressure, flow rate, type of first fluid etc.) of a first fluid outlet and/or of the first fluid in one or more portions of the heat exchanger system (e.g., first set of manifolds and/or second set of manifolds). Determining a setting of a heat exchanger system may be based on one or more properties (e.g., temperature, pressure, flow rate, type of first fluid, etc.) of the air.

In some implementations, determining a setting of a heat exchanger system may be based on a determination of whether changes have occurred in the system in which the heat exchanger system resides. A determination may be made by a controller of the system (e.g., an air conditioner and/or refrigeration system) whether a change has occurred. For example, the controller may determine and/or monitor one or more properties of the system and determine whether a change has occurred. In some implementations, a change may be compared to a retrieved criteria of the heat exchanger system to determine whether to determine a setting based on the determined change. For example, a controller may determine that ice exists on the fan of a condenser housing. However, when the controller retrieves the criteria and compares the determined change to the retrieved criteria, the controller may determine that the ice on the fan does not satisfy the criteria to cause the controller to determine a setting of the heat exchanger system. In some implementations, a controller may determine that a setting of the compressor has changed from part load to full load. The controller may retrieve the criteria and compare the determined change (e.g., compressor load change) to the retrieved criteria to determine that the determined change has satisfied the criteria. When the determined change satisfies the criteria, the controller may determine a setting of the heat exchanger system.

In some implementations, a determination may be made whether a refrigerant stream exiting a first pass of a condenser has a vapor property in a first property range. For example, the degree of mixing of the vapor with the liquid (e.g., degree of homogeneity) may be determined and compared to a predetermined value (e.g., stored in a memory of the controller). The setting may be adjusted and/or restricted from being adjusted based at least partially on the determination of whether the vapor property is in the first property range. In some implementations, a liquid level in the second set of manifolds may be determined. A setting selected may be based on a liquid level in the second manifold. If the liquid level is below a predetermined liquid level, then a setting may be adjusted. For example, a setting may be selected such that the second pass may include flow paths below the liquid level and/or proximate the top of the liquid level. In some implementations, the flow paths above a liquid level may be restricted from being associated with the second pass (e.g., fluid flow through this flow path may be restricted and/or this flow path may be associated with the first pass).

In some implementations, a first pass may allow fluid to flow in a first direction and a second pass may allow fluid to flow in a second opposite direction.

In some implementations, an adjustable heat exchanger system may be utilized with systems in which the first fluid properties at the inlet of the heat exchanger system vary. For example, when one or more compressors are utilized in a system, the properties of the first fluid at the inlet of the heat exchanger system may vary based on the load of the compressor(s). When the system includes more than one fan and/or multi-speed fan(s) (e.g., two-speed fan and/or variable speed fan) to provide fluid flow to the heat exchanger system and/or other heat exchanger systems in the system, the properties of the first fluid at the inlet of the heat exchanger system may vary based on the speed at which the fan(s) are allowed to operate. When the system includes adjustable expansion valves, the properties of the first fluid at the inlet of the heat exchanger system may vary based on the amount of fluid allowed to flow through the expansion valve. Thus, when the first fluid properties fluctuate at the first inlet of the heat exchanger system, by allowing the heat exchanger system to adjust, performance may be increased (e.g., condensation may be more complete when the heat exchanger system is acting as a condenser) and/or problems may be minimized.

For example, a change may be determined (e.g., in a setting of a component of the system in which the heat exchanger system operates). For example, a change in the first fluid at the first fluid inlet may be determined (e.g., when compared to previous first fluid properties, which may be stored in a memory of the system). A setting of the heat exchanger system may be determined based on the determined change and/or one or more properties of the system. The setting may be compared to the current setting of the heat exchanger system to determine whether to adjust the configuration (e.g., the valve positions) of the heat exchanger system and the heat exchanger system may be adjusted if a determined setting is different from the current setting. The heat exchanger system may thus be allowed to operate at the determined setting. A controller of the system and/or the heat exchanger system may perform one or more of these determinations and/or retrieve appropriate information (e.g., for comparisons, for associations of for example, valves and settings, settings and conditions in which settings should be allowed, and/or any other appropriate data).

Although a specific controller has been described, the controller may be any appropriate computer or other programmable logic device. The controller may include a processor that executes instructions (e.g., modules) and manipulates data to perform operations of the controller. The processor may include a programmable logic device, a microprocessor, or any other appropriate device for manipulating information in a logical manner, and the memory may include any appropriate form(s) of volatile and/or nonvolatile memory, such as RAM and/or Flash memory.

The memory may include instructions and/or data, such as predetermined property values (e.g., temperatures and/or pressure); tables of associations to determine settings; and/or any other data useful to the operation of the air conditioner.

In addition, various software may be stored on the memory. For example, instructions (e.g., operating systems and/or other types of software) may be executed by a processor of the controller. The instructions, including an operation module and/or an adjustment module, may be stored on the memory. The operation module may operate the air conditioner and/or components thereof during normal operations (e.g., operations in which the system operates based at least partially on user requests for operation). The adjustment module may perform one or more of the operations in processes 250, 400, portions thereof, and/or combinations thereof. For example, the adjustment module may determine properties; retrieve predetermined property values ranges of values, and/or criteria; compare values and/or criteria; determine settings; determine configurations associated with determined settings; determine whether to retrieve a table of associations between properties (e.g., compressor loads, properties of the heat exchanger system, and/or properties of the system) and settings; allow heat exchanger system operation at a determined setting; and/or other operations.

In some implementations, modules may be combined, such as into a single module or multiple modules. Operation modules and/or adjustment modules may be distinct modules. In an implementation, operation modules and/or adjustment modules may include various modules and/or submodules.

A communication interface may allow the controller to communicate with components of the system, other repositories, and/or other computer systems. The communication interface may transmit data from the controller and/or receive data from other components, other repositories, and/or other computer systems via network protocols (e.g., TCP/IP, Bluetooth, and/or Wi-Fi) and/or a bus (e.g., serial, parallel. USB, and/or FireWire). Operations of the system stored in the memory may be updated and/or altered through the communication via network protocols (e.g., remotely through a firmware update and/or by a device directly coupled to the controller).

The controller may include a presentation interface to present data to a user, such as though a monitor and speakers. The presentation interface may facilitate receipt of requests for operation from users.

The controller 380 may include an input device such as a keyboard, touchscreen, on/off switch, rotary selector or other type of input mechanism. The input device can allow a user to select a temperature, a running level, or a variety of other settings.

A client (e.g., control panel in field or building) may allow a user to access the controller and/or instructions stored on the controller. The client may be a computer system such as a personal computer, a laptop, a personal digital assistant, a smart phone, or any computer system appropriate for communicating with the controller. For example, a technician may utilize a client, such as a tablet computer, to access the controller. As another example, a user may utilize a client, such as a smart phone, to access the controller and request operations.

Although an example of a controller that may be used with the disclosure has been described, the controller can be implemented through computers such as servers, as well as a server pool. For example, the controller may include a general-purpose personal computer (PC), a Macintosh, a workstation, a UNIX-based computer, a server computer, or any other suitable device. In some implementations, the controller may include a programmable logic device. For example, the controller may be mounted to a wall of a location in which air conditioning may be provided. According to one implementation, the controller may include a web server. The controller may be adapted to execute any operating system including UNIX. Linux, Windows, or any other suitable operating system. The controller may include software and/or hardware in any combination suitable to provide access to data and/or translate data to an appropriate compatible format.

Various implementations of the systems and techniques described herein can be realized in digital electronic circuitry, integrated circuitry, specially designed ASICs (application specific integrated circuits), computer hardware, firmware, software, and/or combinations thereof. These various implementations can include implementations in one or more computer programs that are executable and/or interpretable on a programmable system, including at least one programmable processor, which may be special or general purpose, coupled to receive data and instructions from, and to transmit data and instructions to, a storage system, at least one input device, and at least one output device.

These computer programs (also known as programs, software, software applications or code) include machine instructions for a programmable processor, and can be implemented in a high-level procedural and/or object-oriented programming language, and/or in assembly/machine language. As used herein, the term "machine-readable medium" refers to any computer program product, apparatus and/or device (e.g., magnetic discs, optical disks, memory, Programmable Logic Devices (PLDs)) used to provide machine instructions and/or data to a programmable processor, including a machine-readable medium that receives machine instructions as a machine-readable signal. The term "machine-readable signal" refers to any signal used to provide machine instructions and/or data to a programmable processor. The machine-readable signal(s) may be non-transitory waves and/or non-transitory signals.

Although mechanical failure and mechanical failure events have been described as conditions that cause mechanical failure, conditions that precede mechanical failure may also be included, such as excessive wear on parts.

Although users have been described as a human, a user may be a person, a group of people, a person or persons interacting with one or more computers, and/or a computer system.

It is to be understood the implementations are not limited to particular systems or processes described which may, of course, vary. It is also to be understood that the terminology used herein is for the purpose of describing particular implementations only, and is not intended to be limiting. As used in this specification, the singular forms "a", "an" and "the" include plural referents unless the content clearly indicates otherwise. Thus, for example, reference to "a flow path" includes a combination of two or more flow paths and reference to "a conduit" includes different types and/or combinations of conduits.

Although the present disclosure and its advantages have been described in detail, it should be understood that various changes, substitutions and alterations can be made herein without departing from the spirit and scope of the disclosure as defined by the appended claims. Moreover, the scope of the present application is not intended to be limited to the particular embodiments of the process, machine, manufacture, composition of matter, means, methods and steps described in the specification. As one of ordinary skill in the art will readily appreciate from the disclosure of the present invention, processes, machines, manufacture, compositions of matter, means, methods, or steps, presently existing or later to be developed that perform substantially the same function or achieve substantially the same result as the corresponding embodiments described herein may be utilized according to the present invention. Accordingly, the appended claims are intended to include within their scope such processes, machines, manufacture, compositions of matter, means, methods, or steps.

The invention claimed is:

1. A method of operating a multi-pass heat exchanger system, comprising:

determining, by a controller, a flow rate to an inlet of the multi-pass heat exchanger system that comprises a plurality of heat exchangers, a plurality of channels through the plurality of heat exchangers, and a plurality of manifolds connecting the plurality of heat exchangers;

based on the flow rate, selecting, by the controller, a first plurality of channels to be a first pass and selecting a second plurality of channels to be a second pass; and adjusting, by the controller, valves in the multi-pass heat exchanger system to direct a fluid along the first pass and then along the second pass.

2. The method of claim 1 further comprising selecting a third plurality of channels to be a third pass and adjusting valves in the heat exchanger to direct fluid from the second pass to the third pass.

3. The method of claim 2 further comprising selecting a fourth plurality of channels to be a fourth pass and adjusting valves in the heat exchanger to direct fluid from the third pass to the fourth pass.

4. The method of claim 1 further comprising directing air to flow around the first and second plurality of channels.

5. The method of claim 1, wherein the plurality of manifolds comprise a first manifold, a second manifold, and a third manifold.

6. The method of claim 5, wherein the first manifold is coupled to the inlet and operable to selectively direct fluid to the first pass.

7. The method of claim 5, wherein the third manifold is operable to selectively receive fluid from the first pass and direct fluid to the second pass.

8. The method of claim 5, wherein the third manifold further comprises a perforated portion that the fluid passes through.

9. The method of claim 1, wherein the plurality of channels comprise microchannels.

10. A multi-pass heat exchanger system comprising:

a controller that is configured to:

determine a flow rate to an inlet of the multi-pass heat exchanger system that comprises a plurality of heat exchangers, a plurality of channels through the plurality of heat exchangers, and a plurality of manifolds connecting the plurality of heat exchangers;

based on the flow rate, select a first plurality of channels to be a first pass and select a second plurality of channels to be a second pass; and adjust valves in the multi-pass heat exchanger system to direct a fluid along the first pass and then along the second pass.

11. The multi-pass heat exchanger system of claim 10, wherein the plurality of channels comprise microchannels.

12. The multi-pass heat exchanger system of claim 10, wherein the plurality of channels comprise fins.

13. The multi-pass heat exchanger system of claim 10, wherein the controller is further configured to select a third plurality of channels to be a third pass and adjusting valves in the heat exchanger to direct fluid from the second pass to the third pass.

14. The multi-pass heat exchanger system of claim 13, wherein the controller is further configured to select a fourth plurality of channels to be a fourth pass and adjusting valves in the heat exchanger to direct fluid from the third pass to the fourth pass.

15. The multi-pass heat exchanger system of claim 10, wherein the plurality of manifolds comprise a first manifold, a second manifold, and a third manifold.

16. The multi-pass heat exchanger system of claim 15, wherein the first manifold is coupled to the inlet and operable to selectively direct fluid to the first pass.

17. The multi-pass heat exchanger system of claim 15, wherein the third manifold is operable to selectively receive fluid from the first pass and direct fluid to the second pass.

18. A method of operating a multi-pass heat exchanger system, comprising:

determining, by a controller, a flow rate to an inlet of the multi-pass heat exchanger system that comprises a plurality of heat exchangers, a plurality of channels through the plurality of heat exchangers, and a plurality of manifolds connecting the plurality of heat exchangers;

selecting, by the controller, a first plurality of channels to be a first pass, a second plurality of channels to be a second pass, a third plurality of channels to be a third pass and a fourth plurality of channels to be a fourth pass; and adjusting, by the controller, valves in the multi-pass heat exchanger system to direct a fluid along the first pass, the second pass, the third pass and the fourth pass.

19. The method of claim 18, wherein the plurality of channels comprise microchannels.

20. The method of claim 18, wherein the plurality of channels comprise fins.

* * * * *